US010494175B2

(12) United States Patent
Yang et al.

(10) Patent No.: US 10,494,175 B2
(45) Date of Patent: Dec. 3, 2019

(54) RECEPTACLE ASSEMBLIES WITH MOTION DAMPERS

(71) Applicant: simplehuman, LLC, Torrance, CA (US)

(72) Inventors: Frank Yang, Rancho Palos Verdes, CA (US); Di-Fong Chang, Torrance, CA (US); Zachary Rapoport, Northridge, CA (US); Joseph Sandor, Newport Beach, CA (US)

(73) Assignee: simplehuman, LLC, Torrance, CA (US)

( * ) Notice: Subject to any disclaimer, the term of this patent is extended or adjusted under 35 U.S.C. 154(b) by 308 days.

(21) Appl. No.: 15/448,245

(22) Filed: Mar. 2, 2017

(65) Prior Publication Data

US 2017/0253429 A1 Sep. 7, 2017

Related U.S. Application Data

(60) Provisional application No. 62/303,166, filed on Mar. 3, 2016.

(51) Int. Cl.
*B65F 1/16* (2006.01)
*B65F 1/06* (2006.01)

(52) U.S. Cl.
CPC ..... *B65F 1/163* (2013.01); *B65F 1/06* (2013.01); *B65F 2210/00* (2013.01)

(58) Field of Classification Search
CPC .... B65F 1/163; B65F 2001/1661; B65F 1/06; B65F 1/1623
See application file for complete search history.

(56) References Cited

U.S. PATENT DOCUMENTS

| | | | |
|---|---|---|---|
| 830,182 | A | 9/1906 | Skov |
| 1,426,211 | A | 8/1922 | Pausin |
| 1,461,253 | A | 7/1923 | Owen |
| 1,754,802 | A | 4/1930 | Raster |

(Continued)

FOREIGN PATENT DOCUMENTS

| | | |
|---|---|---|
| AU | 622536 | 4/1992 |
| CA | 2182840 | 9/1997 |

(Continued)

OTHER PUBLICATIONS

U.S. Appl. No. 24/484,903, filed Mar. 13, 2014, Yang et al.

(Continued)

*Primary Examiner* — Shawn M Braden
(74) *Attorney, Agent, or Firm* — Knobbe, Martens, Olson & Bear LLP

(57) ABSTRACT

Various embodiments of receptacle assemblies, such as trash cans, are disclosed. In some embodiments, the receptacle assembly includes a body portion with an interior space. The receptacle assembly can include a lid portion configured to move between an open position and a closed position. The receptacle assembly can include a pedal portion operably connected with the lid such that moving the pedal portion moves the lid portion between the open position and the closed position. The receptacle assembly can include a motion damper configured to dampen motion of the lid portion. The motion damper can be positioned near a front of the body portion and/or above a front portion of the pedal portion.

35 Claims, 19 Drawing Sheets

(56) References Cited

U.S. PATENT DOCUMENTS 1,820,555 A 8/1931 Buschman
1,891,651 A 12/1932 Padelford et al.
1,922,729 A 8/1933 Geibel
1,980,938 A 11/1934 Geibel
2,308,326 A 1/1943 Calcagno
D148,825 S 2/1948 Snider
2,457,274 A 12/1948 Rifken
2,759,625 A 8/1956 Ritter
2,796,309 A 6/1957 Taylor
2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,300,082 A 1/1967 Patterson
3,392,825 A 7/1968 Gale et al.
3,451,453 A 6/1969 Heck
3,654,534 A 4/1972 Fischer
3,800,503 A 4/1974 Maki
3,820,200 A 6/1974 Myers
3,825,150 A 7/1974 Taylor
3,825,215 A 7/1974 Borglum
3,886,425 A 5/1975 Weiss
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins, III et al.
4,785,964 A 11/1988 Miller et al.
4,792,039 A 12/1988 Dayton
4,794,973 A 1/1989 Perisic
4,813,592 A 3/1989 Stolzman
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,888,532 A 12/1989 Josson
4,892,223 A 1/1990 DeMent
4,892,224 A 1/1990 Graham
D307,344 S 4/1990 Massonnet
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,076,462 A 12/1991 Perrone
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
D331,097 S 11/1992 Sieren
5,170,904 A 12/1992 Neuhaus
5,174,462 A 12/1992 Hames
D332,852 S 1/1993 Delmerico
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A 7/1994 Feigleson
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.
5,419,452 A 5/1995 Mueller et al.
5,471,708 A 12/1995 Lynch
5,474,201 A 12/1995 Liu
5,501,358 A 3/1996 Hobday
5,520,067 A 5/1996 Gaba
5,520,303 A 5/1996 Bernstein et al.
5,531,348 A 7/1996 Baker et al.
5,535,913 A 7/1996 Asbach et al.
5,558,254 A 9/1996 Anderson et al.
5,560,283 A 10/1996 Hannig
5,584,412 A 12/1996 Wang
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.
5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia

(56) References Cited

U.S. PATENT DOCUMENTS 5,770,935 A 6/1998 Smith et al.
5,799,909 A 9/1998 Ziegler
5,816,431 A 10/1998 Giannopoulos
5,816,640 A 10/1998 Nishimura
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
D412,552 S 8/1999 Burrows
5,961,105 A 10/1999 Ehrnsberger et al.
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,105,859 A 8/2000 Stafford
6,123,215 A 9/2000 Windle
D431,700 S 10/2000 Roudebush
6,126,031 A 10/2000 Reason
6,129,233 A 10/2000 Schiller
6,131,861 A 10/2000 Fortier, Jr. et al.
D435,951 S 1/2001 Yang et al.
6,209,744 B1 4/2001 Gill
6,211,637 B1 4/2001 Studer
6,234,339 B1 5/2001 Thomas
6,250,492 B1 6/2001 Verbeek
D445,980 S 7/2001 Tjugum
6,286,706 B1 9/2001 Tucker
6,328,320 B1 12/2001 Walski et al.
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
6,519,130 B1 2/2003 Breslow
6,557,716 B1 5/2003 Chan
D476,456 S 6/2003 Englert et al.
6,596,983 B2 7/2003 Brent
6,626,316 B2 9/2003 Yang
6,626,317 B2 9/2003 Pfiefer et al.
6,632,064 B1 10/2003 Walker et al.
D481,846 S 11/2003 Lin
D482,169 S 11/2003 Lin
6,659,407 B2 12/2003 Asaro
6,681,950 B2 1/2004 Miller, Jr. et al.
D488,604 S 4/2004 Yang et al.
D488,903 S 4/2004 Yang et al.
D489,503 S 5/2004 Lin
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,812,655 B1 11/2004 Wang et al.
6,814,249 B2 11/2004 Lin
D499,450 S 12/2004 Goodman et al.
6,837,393 B1 1/2005 Kuo
6,857,538 B2 2/2005 Lin
6,859,005 B2 2/2005 Boliver
D503,021 S 3/2005 Yang et al.
6,866,826 B2 3/2005 Moore et al.
6,883,676 B2 4/2005 Lin
D507,090 S 7/2005 Yang et al.
6,920,994 B2 7/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 3/2006 Gruber et al.
7,044,323 B2 5/2006 Yang
D525,756 S 7/2006 Yang et al.
7,073,677 B2 7/2006 Richardson et al.
7,077,283 B2 7/2006 Yang et al.
7,080,750 B2 7/2006 Wein et al.
7,086,550 B2 8/2006 Yang et al.
D528,726 S 9/2006 Lin
7,121,421 B2 10/2006 Yang et al.
D531,499 S 11/2006 Zaidman
D535,799 S 1/2007 Epps
D535,800 S 1/2007 Yang et al.
7,163,591 B2 1/2007 Kim et al.
7,168,591 B1 1/2007 Miller
D537,223 S 2/2007 Lin
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al.
D542,995 S 5/2007 Lin
D543,673 S 5/2007 Yang et al.
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,319 S 10/2007 Gusdorf
D552,321 S 10/2007 Yang et al.
D552,823 S 10/2007 Yang et al.
D552,824 S 10/2007 Zimmerman
D552,825 S 10/2007 Yang et al.
D555,320 S 11/2007 Yang et al.
D559,494 S 1/2008 Yang et al.
D559,495 S 1/2008 Yang et al.
D562,522 S 2/2008 Daams
7,328,842 B2 2/2008 Wagner et al.
D564,169 S 3/2008 Wang
D564,723 S 3/2008 Yang et al.
D566,367 S 4/2008 Lin
D566,369 S 4/2008 Shek
D566,923 S 4/2008 Lin
D567,468 S 4/2008 Yang et al.
D568,572 S 5/2008 Yang et al.
D569,720 S 5/2008 Lablaine
7,374,060 B2 5/2008 Yang et al.
D571,520 S 6/2008 Lin
7,395,990 B1 7/2008 Stevens
7,398,913 B2 7/2008 McClure
7,404,499 B1 7/2008 Ramsey
D574,569 S 8/2008 Yang et al.
D576,371 S 9/2008 Zimmerman
D578,265 S 10/2008 Presnell
D578,266 S 10/2008 Yang et al.
D578,268 S 10/2008 Yang et al.
D578,722 S 10/2008 Yang et al.
7,438,199 B1 10/2008 Tidrick
D580,120 S 11/2008 Lin
D580,613 S 11/2008 Yang et al.
D580,615 S 11/2008 Yang et al.
D581,622 S 11/2008 Presnell et al.
D584,470 S 1/2009 Bizzell et al.
D585,171 S 1/2009 Bizzell et al.
D585,618 S 1/2009 Yang et al.
D586,070 S 2/2009 Lin
7,494,021 B2 2/2009 Yang et al.
D587,874 S 3/2009 Lin
D593,271 S 5/2009 Yang et al.
7,530,578 B2 5/2009 Niemeyer et al.
7,540,396 B2 6/2009 Yang et al.
7,543,716 B2 6/2009 Lin

(56) References Cited

U.S. PATENT DOCUMENTS 7,559,433 B2 7/2009 Yang et al.
D599,074 S 8/2009 Bizzell et al.
D603,119 S 10/2009 Yang et al.
7,607,552 B2 10/2009 Efstathiou
D604,472 S 11/2009 Blanks et al.
7,614,519 B2 11/2009 Krauth et al.
7,621,420 B2 11/2009 Bandoh et al.
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D630,404 S 1/2011 Yang et al.
D631,221 S 1/2011 Yang et al.
D632,039 S 2/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
D655,061 S 2/2012 Scaturro
8,136,688 B2 * 3/2012 Lee ..... B65F 1/163 220/262
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,418,869 B2 4/2013 Yang et al.
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,672,171 B2 3/2014 Wynn et al.
8,678,219 B1 3/2014 Wang et al.
8,686,676 B2 4/2014 Yang et al.
D704,406 S 5/2014 Kern
8,716,969 B2 5/2014 Yang et al.
8,720,728 B2 5/2014 Yang et al.
D709,662 S 7/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D715,575 S 10/2014 Williams et al.
D716,015 S 10/2014 van de Leest
8,851,316 B2 10/2014 Barrett et al.
8,872,459 B2 10/2014 Yang et al.
D725,860 S 3/2015 Spivey et al.
D725,861 S 3/2015 Yang et al.
D730,008 S 5/2015 Yang et al.
9,051,093 B2 6/2015 Yang et al.
D755,461 S 5/2016 Wall
D758,686 S 6/2016 Beumer
D759,934 S 6/2016 Yang et al.
D762,037 S 7/2016 Chen
D765,937 S 9/2016 Chen
D766,998 S 9/2016 Kao et al.
9,434,538 B2 9/2016 Yang et al.
D770,121 S 10/2016 Chen
D771,344 S 11/2016 Yang et al.
D773,145 S 11/2016 Yang et al.
9,481,515 B2 11/2016 Yang et al.
D773,769 S 12/2016 Chen
9,573,759 B2 2/2017 Yang et al.
9,586,755 B1 3/2017 Yang et al.
D787,828 S 5/2017 Thoma et al.
D790,145 S 6/2017 Chen
D793,642 S 8/2017 Yang et al.
D798,016 S 9/2017 Yang et al.
D804,133 S 9/2017 Yang et al.
9,751,692 B2 9/2017 Yang et al.
9,856,080 B2 1/2018 Yang et al.
9,970,025 B2 5/2018 Alphey
D820,544 S 6/2018 Joseph
D825,876 S 8/2018 Chen
D829,400 S 9/2018 Yang et al.
D830,029 S 10/2018 Greenspoon et al.
D835,374 S 12/2018 Yang et al.
D835,376 S 12/2018 Yang et al.
10,279,996 B2 5/2019 Yang et al.
10,279,997 B2 5/2019 Yang et al.
2001/0002690 A1 6/2001 Rosky
2001/0020619 A1 9/2001 Pfeifer et al.
2001/0045512 A1 11/2001 Brent
2002/0066736 A1 6/2002 Pyles
2002/0092853 A1 7/2002 Wang
2002/0096523 A1 7/2002 Pyles
2002/0096524 A1 7/2002 Hardesty
2002/0100758 A1 8/2002 Pyles
2002/0104266 A1 8/2002 Ranaudo
2002/0116924 A1 8/2002 Winkelmann et al.
2003/0089719 A1 5/2003 Berger
2003/0102316 A1 6/2003 Forest
2003/0201265 A1 10/2003 Lin
2003/0205979 A1 11/2003 Papari et al.
2003/0230576 A1 12/2003 Lin
2004/0016756 A1 1/2004 Lin
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0250711 A1 12/2004 Ernst
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0129803 A1 6/2005 Umeda et al.
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.
2006/0138149 A1 6/2006 Tracy
2006/0163257 A1 7/2006 Golbert
2006/0175336 A1 8/2006 Wang
2006/0186121 A1 8/2006 Yang et al.
2006/0196874 A1 9/2006 Yang
2006/0213910 A1 * 9/2006 Yang ..... B65F 1/163 220/264
2006/0237641 A1 10/2006 Moeller et al.
2006/0249510 A1 11/2006 Lin
2006/0278643 A1 12/2006 Chiou
2007/0012699 A1 1/2007 Yang et al.
2007/0034334 A1 2/2007 Ramsey et al.

(56) References Cited

U.S. PATENT DOCUMENTS

| | | | |
|---|---|---|---|
| 2007/0045326 | A1 | 3/2007 | Tramontina et al. |
| 2007/0090112 | A1 | 4/2007 | Kalman et al. |
| 2007/0114847 | A1 | 5/2007 | Ichimaru et al. |
| 2007/0181579 | A1 | 8/2007 | Kuo et al. |
| 2007/0209846 | A1 | 9/2007 | Wilson |
| 2007/0215622 | A1 | 9/2007 | Perez |
| 2007/0241109 | A1 | 10/2007 | Lin |
| 2007/0266637 | A1 | 11/2007 | McGowan |
| 2007/0272691 | A1 | 11/2007 | Wang et al. |
| 2007/0289972 | A1 | 12/2007 | Wynn et al. |
| 2008/0011754 | A1 | 1/2008 | Ramsey |
| 2008/0011910 | A1 | 1/2008 | Ramsey |
| 2008/0041863 | A1 | 2/2008 | Forest |
| 2008/0083756 | A1 | 4/2008 | Daniels |
| 2008/0083757 | A1 | 4/2008 | Parker et al. |
| 2008/0099274 | A1 | 5/2008 | Seel |
| 2008/0128428 | A1 | 6/2008 | Beckerman |
| 2008/0164257 | A1 | 7/2008 | Boll et al. |
| 2008/0236275 | A1 | 10/2008 | Breed et al. |
| 2008/0257889 | A1 | 10/2008 | Kovacevich et al. |
| 2008/0257890 | A1 | 10/2008 | Kovacevich et al. |
| 2008/0257891 | A1 | 10/2008 | Kovacevich et al. |
| 2008/0264948 | A1 | 10/2008 | Kovacevich et al. |
| 2008/0264950 | A1 | 10/2008 | Kovacevich et al. |
| 2008/0272119 | A1 | 11/2008 | Efstathiou |
| 2008/0272127 | A1 | 11/2008 | Kovacevich et al. |
| 2009/0071959 | A1 | 3/2009 | Cheung |
| 2009/0084788 | A1 | 4/2009 | Yang et al. |
| 2009/0136341 | A1 | 5/2009 | Kenyon |
| 2009/0230131 | A1 | 9/2009 | McDuffie et al. |
| 2009/0261105 | A1 | 10/2009 | Cunningham et al. |
| 2009/0266836 | A1 | 10/2009 | Mobley |
| 2010/0006572 | A1 | 1/2010 | Chiou |
| 2010/0084235 | A1 | 4/2010 | Lu |
| 2010/0096894 | A1 | 4/2010 | Fukai |
| 2010/0122985 | A1 | 5/2010 | Peters et al. |
| 2010/0147865 | A1 | 6/2010 | Yang et al. |
| 2010/0170904 | A1 | 7/2010 | Kalman et al. |
| 2010/0178105 | A1 | 7/2010 | Monneret |
| 2010/0193518 | A1 | 8/2010 | Tontarelli |
| 2010/0237074 | A1 | 9/2010 | Yang et al. |
| 2010/0252557 | A1 | 10/2010 | Clements |
| 2010/0294769 | A1 | 11/2010 | Lee et al. |
| 2011/0017735 | A1 | 1/2011 | Wang et al. |
| 2011/0049149 | A1 | 3/2011 | Shih |
| 2011/0056952 | A1 | 3/2011 | Borowski et al. |
| 2011/0139781 | A1 | 6/2011 | Jin et al. |
| 2011/0272409 | A1 | 11/2011 | Kasbohm |
| 2012/0145932 | A1 | 6/2012 | Yao et al. |
| 2012/0234849 | A1 | 9/2012 | Hughes et al. |
| 2012/0261423 | A1 | 10/2012 | Zawrotny et al. |
| 2013/0048641 | A1 | 2/2013 | Romano |
| 2013/0097809 | A1 | 4/2013 | Weber et al. |
| 2013/0098913 | A1 | 4/2013 | Yang et al. |
| 2013/0105487 | A1 | 5/2013 | Baik |
| 2013/0233857 | A1 | 9/2013 | Yang et al. |
| 2013/0240592 | A1 | 9/2013 | Woodruff |
| 2013/0248535 | A1 | 9/2013 | Wolfe et al. |
| 2013/0300119 | A1 | 11/2013 | Anzalon et al. |
| 2014/0183193 | A1 | 7/2014 | Hammond et al. |
| 2014/0238989 | A1 | 8/2014 | Wang et al. |
| 2014/0305946 | A1 | 10/2014 | Han |
| 2014/0345453 | A1 | 11/2014 | Oh et al. |
| 2015/0251849 | A1 | 9/2015 | Yang et al. |
| 2015/0259139 | A1 | 9/2015 | Yang et al. |
| 2015/0259140 | A1 | 9/2015 | Yang et al. |
| 2015/0321841 | A1 | 11/2015 | Salas et al. |
| 2016/0200508 | A1* | 7/2016 | Thoma ..... B65F 1/163 220/495.11 |
| 2017/0050404 | A1 | 2/2017 | Henken et al. |
| 2017/0096299 | A1 | 4/2017 | Yang et al. |
| 2017/0127669 | A1 | 5/2017 | Yang et al. |
| 2017/0166167 | A1 | 6/2017 | Heller et al. |
| 2018/0093827 | A1 | 4/2018 | Yang et al. |
| 2018/0178978 | A1 | 6/2018 | Yang et al. |
| 2018/0305120 | A1 | 10/2018 | Yang et al. |
| 2019/0077595 | A1 | 3/2019 | Wang et al. |

FOREIGN PATENT DOCUMENTS

| | | | |
|---|---|---|---|
| CA | 2519295 | | 3/2007 |
| CN | 2075182 | U | 4/1991 |
| CN | 101177946 | A | 5/2008 |
| CN | 201105898 | Y | 8/2008 |
| CN | 201372076 | Y | 12/2009 |
| CN | 201447201 | U | 5/2010 |
| CN | 201512253 | U | 6/2010 |
| CN | 201597962 | U | 10/2010 |
| CN | 103207416 | A | 7/2013 |
| CN | 205169479 | U | 4/2016 |
| DE | 1610087 | | 7/1950 |
| DE | 822376 | | 11/1951 |
| DE | 1283741 | | 7/1966 |
| DE | 8436939 | | 3/1985 |
| DE | 9108341 | | 10/1991 |
| DE | 4225936 | | 2/1994 |
| DE | 19525885 | | 3/1997 |
| DE | 19617823 | | 11/1997 |
| DE | 19809331 | | 5/1999 |
| DE | 29918687 | | 3/2000 |
| DE | 19933180 | | 1/2001 |
| DE | 10148997 | | 4/2003 |
| DE | 20217561 | | 3/2004 |
| DE | 10337806 | A1 | 3/2005 |
| EP | 0582240 | | 7/1993 |
| EP | 0903305 | A1 | 3/1999 |
| EP | 0906876 | A2 | 4/1999 |
| EP | 1094017 | A1 | 4/2001 |
| EP | 1361176 | A1 | 11/2003 |
| EP | 1136393 | B1 | 4/2004 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 2343250 | A1 | 7/2011 |
| EP | 3042864 | A1 | 7/2016 |
| FR | 2887152 | | 12/2006 |
| GB | 191004921 | | 6/1910 |
| GB | 2384418 | | 7/2003 |
| JP | 02-152670 | | 6/1990 |
| JP | H06-56011 | | 8/1994 |
| JP | 06-272888 | | 9/1994 |
| JP | 2004-106713 | | 4/2004 |
| JP | 2004-231237 | | 8/2004 |
| JP | D1300450 | | 5/2007 |
| JP | D1300451 | | 5/2007 |
| JP | D1322056 | | 2/2008 |
| JP | D1398668 | | 10/2010 |
| KR | 3003841370000 | | 6/2005 |
| KR | 3004095430000 | | 3/2006 |
| KR | 3004095430001 | | 7/2006 |
| NL | 6908550 | | 12/1970 |
| TW | 230977 | | 9/1994 |
| TW | D112733 | | 9/2006 |
| WO | WO 92/02430 | A1 | 2/1992 |
| WO | WO 96/33671 | | 10/1996 |
| WO | WO 2005/080232 | A1 | 9/2005 |
| WO | WO 2006/079263 | A1 | 8/2006 |
| WO | WO 2009/114495 | A1 | 9/2009 |
| WO | WO 2015/134902 | A1 | 9/2015 |
| WO | WO 2015/138625 | A1 | 9/2015 |
| WO | WO 2016/054109 | A1 | 4/2016 |

OTHER PUBLICATIONS

U.S. Appl. No. 29/548,018, filed Dec. 9, 2015, Yang et al.
U.S. Appl. No. 29/557,032, filed Mar. 4, 2016, Yang et al.
U.S. Appl. No. 29/557,088, filed Mar. 4, 2016, Yang et al.
U.S. Appl. No. 29/584,385, filed Nov. 14, 2016, Yang et al.
U.S. Appl. No. 15/476,285, filed Mar. 31, 2017, Yang et al.

(56) References Cited

OTHER PUBLICATIONS

Trento Corner 23 Trash Can, Hailo product webpage, May 2008, http://www.hailo.de/html/default.asp?site=12_71_107&leng=en.
Simplehuman Liner Rim Dual Bucket Rectangular Recycler with Liner Pocket, Stainless Steel, 58 Liter / 15 Gallon, Item No. CW2025, www.Amazon.com, site visited Dec. 29, 2015.
U.S. Appl. No. 29/583,627, filed Jun. 22, 2017, Yang et al.
U.S. Appl. No. 29/608,587, filed Jun. 22, 2017, Yang et al.
U.S. Appl. No. 29/610,345, filed Jul. 11, 2017, Yang et al.
U.S. Appl. No. 15/809,218, filed Nov. 10, 2017, Yang et al.
U.S. Appl. No. 29/633,369, filed Jan. 12, 2018, Yang et al.
U.S. Appl. No. 29/633,372, filed Jan. 12, 2018, Yang et al.
U.S. Appl. No. 16/284,996, filed Feb. 25, 2019, Yang et al.
U.S. Appl. No. 16/293,463, filed Mar. 5, 2019, Yang et al.
Web page showing picture of Hero Bullet trash can, archived Nov. 17, 2004, downloaded from http://web.archive.org/web/2041117003115/http://www.simplehuman.com/images/hero_bullet.jpg.

* cited by examiner

RECEPTACLE ASSEMBLIES WITH MOTION DAMPERS

CROSS REFERENCE

This application claims the priority benefit under 35 U.S.C. § 119 of U.S. Patent Application No. 62/303,166, filed Mar. 3, 2016, the entirety of which is incorporated by reference herein. This application also incorporates by reference the entirety of U.S. patent application Ser. No. 29/557,032, filed Mar. 4, 2016.

BACKGROUND

Field

This disclosure relates to receptacle assemblies with motion dampers, such as trash cans that have a motion damper for slowing a closing motion of a lid.

Description of Certain Related Art

Trash cans are containers for holding trash and other waste. Some trash cans have a lid to contain the trash and its associated odor. Some trash cans have a foot pedal positioned adjacent a base of the trash can so that a user can step on the foot pedal to open the lid of the trash can.

SUMMARY

Various embodiments of receptacle assemblies, such as trash cans, are disclosed. In some embodiments, the receptacle assembly includes a body portion and a base unit. The body portion can comprise an interior space. The receptacle assembly can include a lid portion movably engaged with the body portion. The lid portion can be configured to move between an open position and a closed position. The receptacle assembly can include a pedal portion operably connected with the lid such that moving the pedal portion moves the lid portion between the open position and the closed position. For example, a linkage, such as a rod, can operably connect the lid portion and the pedal portion. The receptacle assembly can include a motion damper configured to dampen motion of the pedal portion and/or the lid portion. The motion damper can be positioned near a front of the body portion and/or above a front portion of the pedal portion. The receptacle assembly can include a secondary motion damper, such as a damper positioned in a rear of the receptacle assembly. The secondary motion damper can be configured to dampen movement of the lid, such as during movement from the closed position to the open position and/or from the open position to the closed position.

For purposes of summarizing the disclosure, certain aspects, advantages and features of the inventions have been described herein. Not necessarily any or all such advantages are achieved in accordance with any particular embodiment of the inventions disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

The abovementioned and other features of the embodiments disclosed herein are described below with reference to the drawings. The drawings show embodiments that are intended to illustrate, but not to limit, the scope of this disclosure. Various features of the different disclosed embodiments can be combined to form further embodiments, which are part of this disclosure.

DETAILED DESCRIPTION OF CERTAIN EMBODIMENTS

Various receptacle assemblies are described. The receptacle assemblies are described in the context of a trash can, due to particular utility in that context. However, the embodiments and inventions disclosed herein can also be applied to other types of devices and other environments, such as recycling bins, diaper pails, medical waste bins, or otherwise. No features, structure, or step disclosed herein is essential or indispensable.

1. Overview

Figure 1:
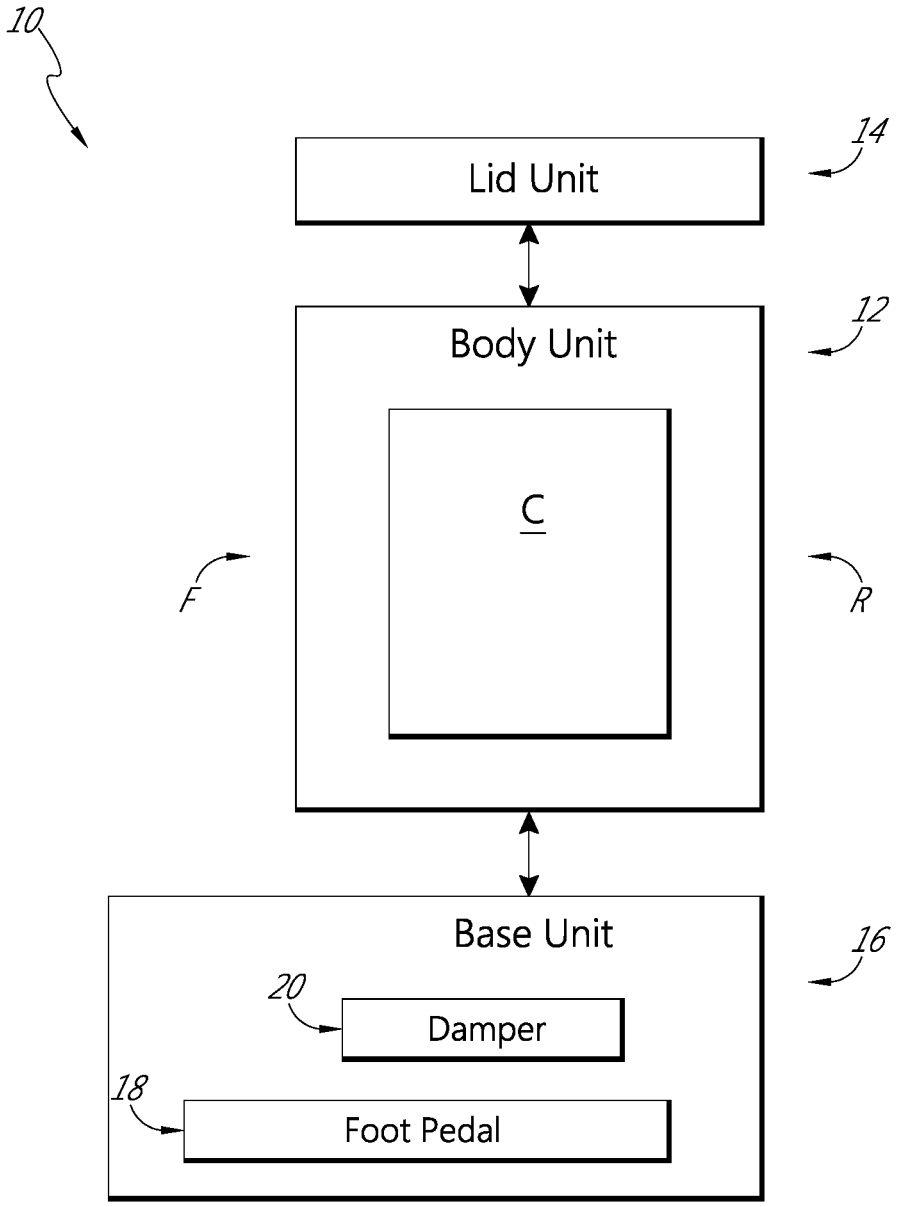
FIG. 1 schematically illustrates an embodiment of a receptacle assembly.
Figure 2:
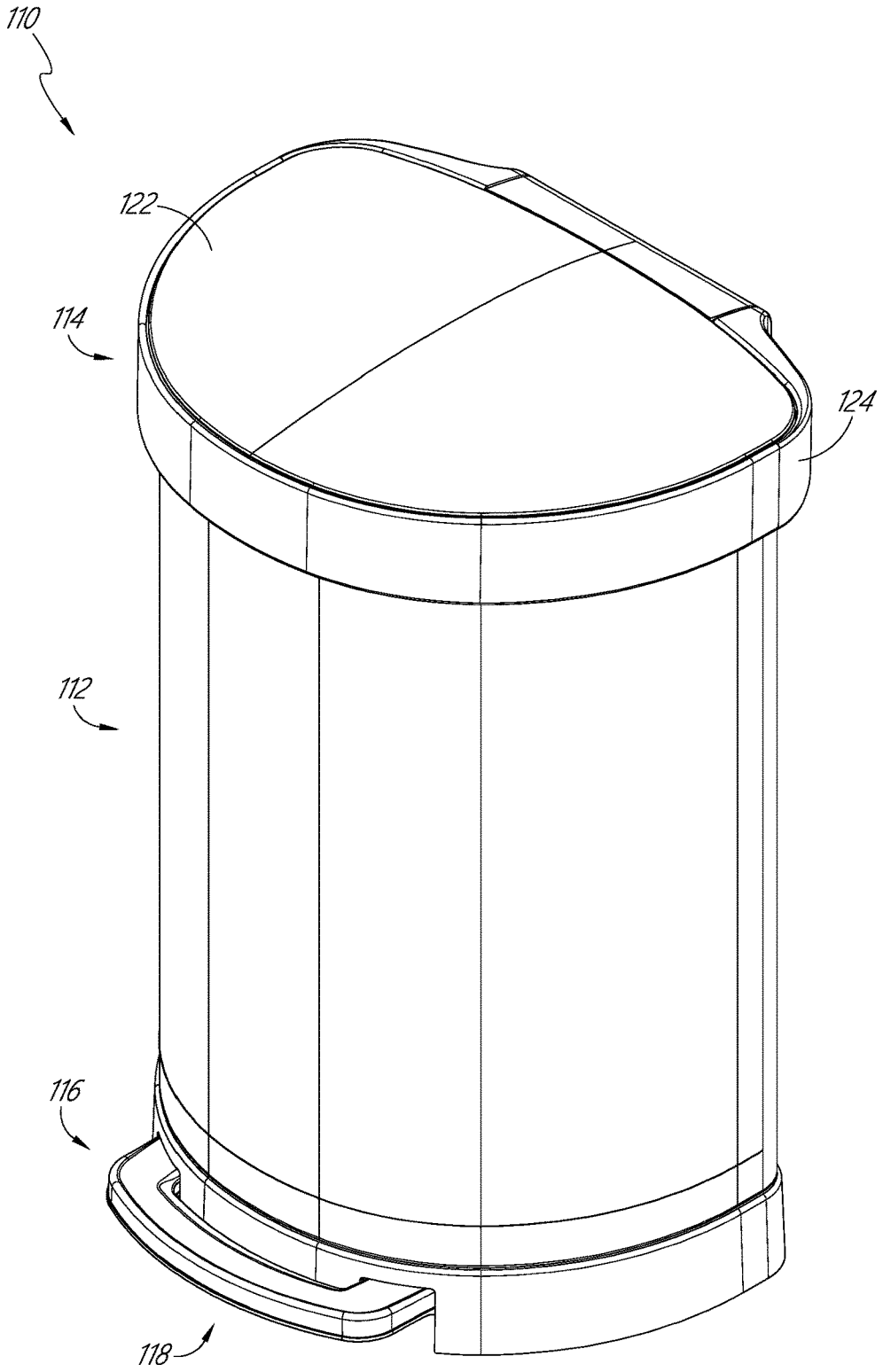
FIG. 2 illustrates a front, top, left side perspective view of an embodiment of a receptacle assembly with a lid in a closed position.
Figure 3:
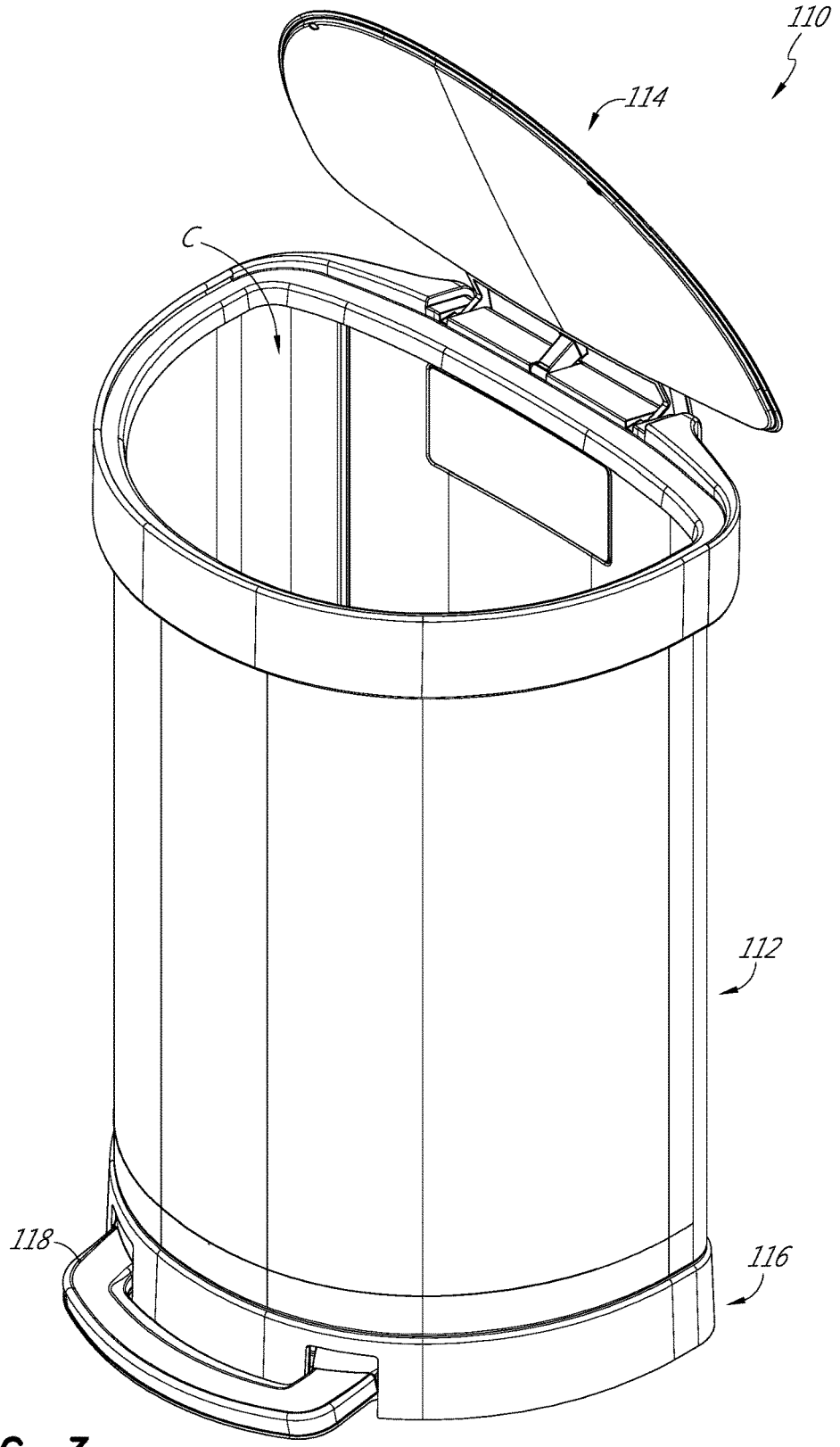
FIG. 3 illustrates a front, top, left side perspective view of the receptacle assembly of FIG. 2 with the lid in an open position.
Figure 4:
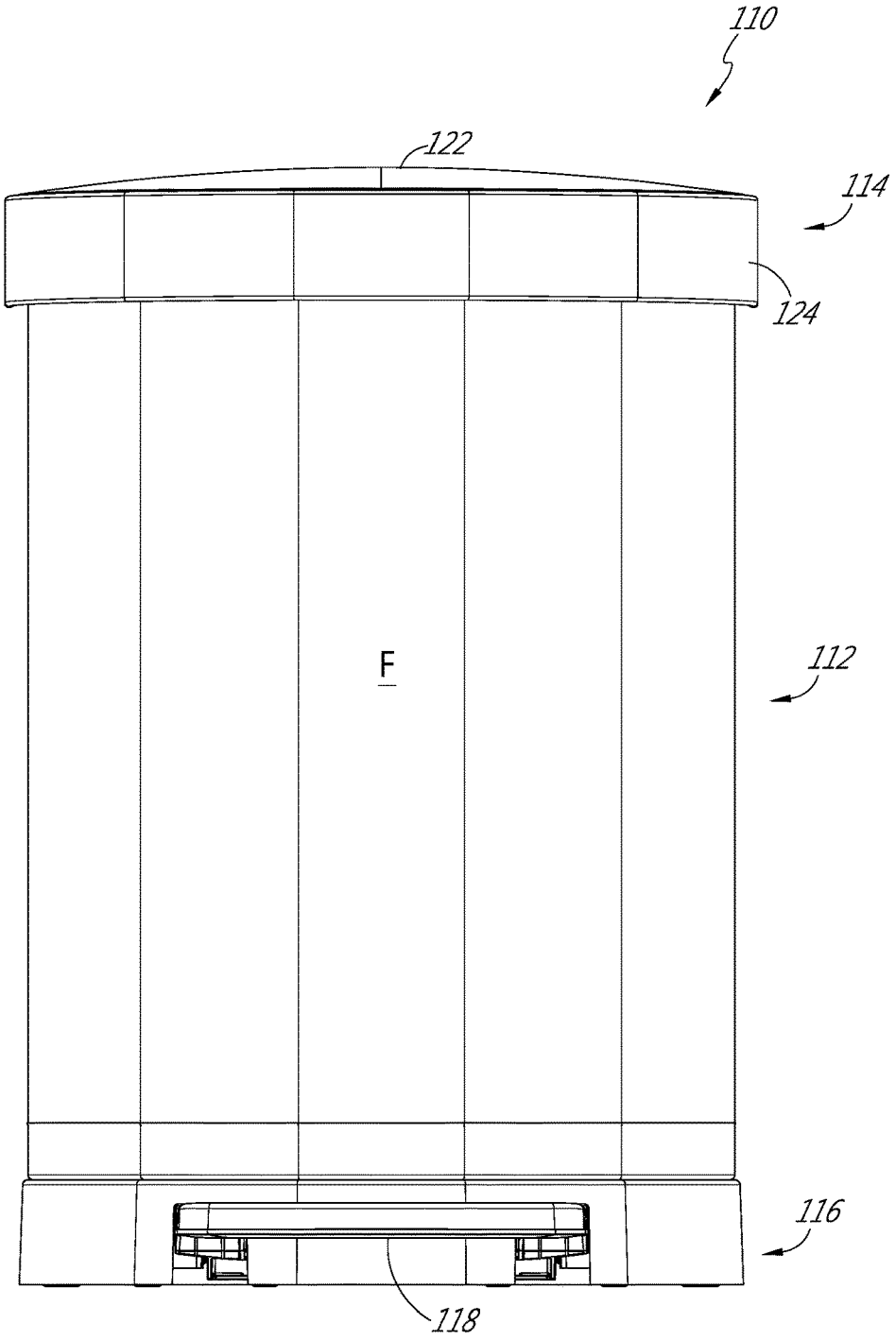
FIG. 4 illustrates a front elevation view of the receptacle assembly of FIG. 2.

FIG. 1 schematically illustrates an embodiment of a receptacle assembly 10, such as a trash can. As shown, the receptacle assembly 10 can include a body unit 12, lid unit 14, and base unit 16. The body unit 12 can have a front F and a rear R, such as a front wall and a rear wall. The body unit 12 can include a chamber C for receiving articles, such as trash.

The lid unit 14 can be coupled with the body unit 12. The lid unit 14 can include a lid that can be moved (e.g., pivoted)

relative to the body unit 12 between open and closed positions. In certain embodiments, in the open position, the lid is generally vertical and, in the closed position, the lid is generally horizontal. With the lid in the open position, a user can readily access the chamber C in the body unit 12.

The base unit 16 can be coupled with the body unit 12. As shown, the base unit 16 can include an actuator, such as a foot pedal 18. The foot pedal 18 can be operably connected with the lid unit 14 such that movement of the foot pedal 18 results in movement of the lid 14. For example, the foot pedal 18 can be operably connected with the lid 14 with a linkage, such as a rod, such that depressing the foot pedal 18 opens the lid 14.

As also shown, the base unit 16 can include a motion damper 20. The motion damper 20 can be configured to dampen movement of the lid 14 and/or the foot pedal 18. As schematically illustrated, in some embodiments, the motion damper 20 is positioned near (e.g., adjacent) the front F of the body unit 12. As also schematically illustrated, a portion of the motion damper 20 can be higher than the foot pedal 18 and/or a portion of the motion damper 20 can be lower than the chamber C. In certain variants, the motion damper 20 is received at least partly in the foot pedal 18, such as in a recess in the foot pedal 18. In some embodiments, when a user depresses a front portion of the foot pedal 18, the lid 14 opens; and when the user releases the foot pedal 18, the lid 14 closes and the motion damper 20 dampens movement of the foot pedal 18 and/or the lid 14.

FIGS. 2-12 illustrate another embodiment of a receptacle assembly 110, which can include any combination of the features of the receptacle assembly 10. Many of the features of the receptacle assembly 110 are the same as, or similar to, the features described above in connection with the receptacle assembly 10. To illustrate such correspondence, many of the numerals used to identify features of the receptacle assembly 110 are incremented by a factor of one hundred relative to the numerals used in connection with the receptacle assembly 10. This numbering system is used throughout this specification. Any component or step disclosed in any embodiment in this specification can be used in any other embodiment.

As shown, the receptacle assembly 110 can include a body unit 112, a lid unit 114, and a base unit 116. The base unit 116 can include a foot pedal 118 and a motion damper 120. These and other features are described in more detail below.

2. Body Unit

The body unit 112 can include a front wall F, a rear wall R, and a chamber C that is configured to receive articles, such as trash. In some embodiments, the front and rear walls are connected by sidewalls. For purposes of presentation, the figures show the body unit 112 as having a semi-cylindrical shape (e.g., rounded in front and generally flat in the rear). However, other shapes are also within the scope of this disclosure, such as cylindrical, right rectangular prismatic, rectangular cuboidic, or rectangular parallelepipedic, etc. In certain embodiments, the body unit 112 is formed of metal (e.g., sheet stainless steel, sheet aluminum, etc.), plastic, or other materials. For example, the body unit 112 can comprise a shell formed of stainless sheet, such as 23 to 26 gauge stainless sheet. Further details regarding the body unit 112 and other features can be found in U.S. Pat. No. 9,051,093, issued Jun. 9, 2015, the entirety of which is hereby incorporated by reference herein.

In various embodiments, the body unit 112 has an upper peripheral edge that is configured to engage with a liner, such as a trash bag. For example, some embodiments have a peripheral edge with an outward flange configured to engage with and retain the lip of a trash bag. In certain variants, the peripheral edge comprises a rounded (e.g., rolled-over) metal edge. The trash bag can hang downwardly from the peripheral edge into the chamber C. In some embodiments, the body unit 112 is configured to directly receive the trash bag, without the need for a separate generally rigid liner bucket that fits inside the body unit 112. For example, as described in more detail below, the base unit 116 can have a generally upwardly facing bottom interior surface that can support a bottom of the trash bag.

Some variants include a generally rigid liner bucket, such as a bucket made from hard plastic. The liner bucket can be received in the chamber C and can include an upper peripheral edge configured to engage with a trash bag. A portion of the trash bag can hang downwardly from the attached upper edge into the liner bucket. In some variants, the liner bucket is configured to contain leaks and/or spills from the trash bag. For example, in some embodiments, a bottom of the liner bucket has no holes visible to a user.

3. Lid Unit

The lid unit 114 can include a lid 122 that is moveably coupled with the body unit 112, such as with a hinge. The lid 122 can be configured to pivot relative to the body unit 112. This can enable the lid 122 to rotate into the open position to open the receptacle assembly 110 (e.g., to allow a user to insert trash into a trash bag in the chamber C) and to rotate into the closed position to close the receptacle assembly 110. In various embodiments, in the closed position the lid 122 is at an angle of about 0° (e.g., relative to horizontal) and/or in the open position the lid 122 is at an angle of about 90°. In some embodiments, in the open position, the lid 122 is at an angle of less that 90°, such as less than or equal to about: 65°, 70°, 75°, 80°, 85°, angles between the aforementioned angles, or other angles.

As shown, the lid unit 114 can include a trim member 124. In some embodiments, the trim member 124 can receive the lid 122 (when in the closed position) and/or can obscure the upper peripheral edge of the body unit 112 (which can be engaged with the trash bag). In some implementations, the trim member 124 is pivotally connected with the rear region R of the body unit 112. For example, the trim member 124 can be pivotally coupled to the rear region R and configured to rotate about a pivot axis in common with the lid 122. The trim member 124 can be made of various materials, such as plastic or metal. The trim member 124 and the body unit 112 can be made from the same or different materials. For example, the trim member 124 and the body unit 112 can comprise a plastic material. In some embodiments, the trim member 124 can engage and/or overlap the upper edge of the body unit 112. Further details regarding the trim member and other features can be found in U.S. Patent Application Publication No. 2013/0233857, filed Mar. 6, 2013, the entirety of which is hereby incorporated by reference herein.

The lid unit 114 can be connected with a force-communicating linkage, such as a rod 126. As illustrated, the rod 126 can extend from a region at or near the lid unit 114 to a region at or near the foot pedal 118. The rod 126 can include an elongate portion (e.g., a majority of the length of the rod) that is generally parallel to the longitudinal axis of the receptacle assembly 110.

The rod 126 can include an upper portion interfaced with the lid unit 114 and a lower portion interfaced with the foot pedal 118. For example, the upper portion of the rod 126 can engage with an engagement region (e.g., a slotted receiving structure) of the lid 122 and the lower portion can engage with a rear feature (e.g., an aperture) of the foot pedal 118. As described in more detail below, depressing the front portion of the foot pedal 118 can move the rear portion of the foot pedal 118 upward, which drives the rod 126 upward, which in turn drives the lid 122 toward the open position. Releasing the front portion of the foot pedal 118 allows the rear portion of the foot pedal 118 to move downward, which allows the rod 126 to move downward, which in turn allows the lid 122 to move toward the closed position.

In various embodiments, the receptacle assembly 110 is configured such that the rod 126 does not occupy space in the chamber C and/or does not engage with a trash bag in the chamber C. For example, as illustrated, the lower portion of the rod 126 can pass through an opening in the base unit 116 and extend upward external to the body unit 112. As further illustrated, in some embodiments, the entire rod 126 that is higher than the base unit 116 is located external to the body unit 112. In some embodiments, the connection between the rod 126 and the lid unit 114 can be positioned in a rear housing 128 and can be external to the chamber C. In various implementations, some or all of the rod 126 is located outside of the chamber C. For example, in some embodiments, no portion of the rod 126, or at least not a majority of the rod 126, is in the chamber C.

4. Base Unit

The receptacle assembly 110 can be configured to rest on the base unit 116. The base unit 116 can be positioned lower than, and configured to support, the body unit 112 and the lid unit 114. The body unit 112 can extend upward from the base unit 116. In some embodiments, the body unit 112 and the base unit 116 are made of different materials, such as the base unit 116 being plastic and the body unit 112 being metal (e.g., stainless steel).

4A. Upper and Lower Base Portions

Figure 9:
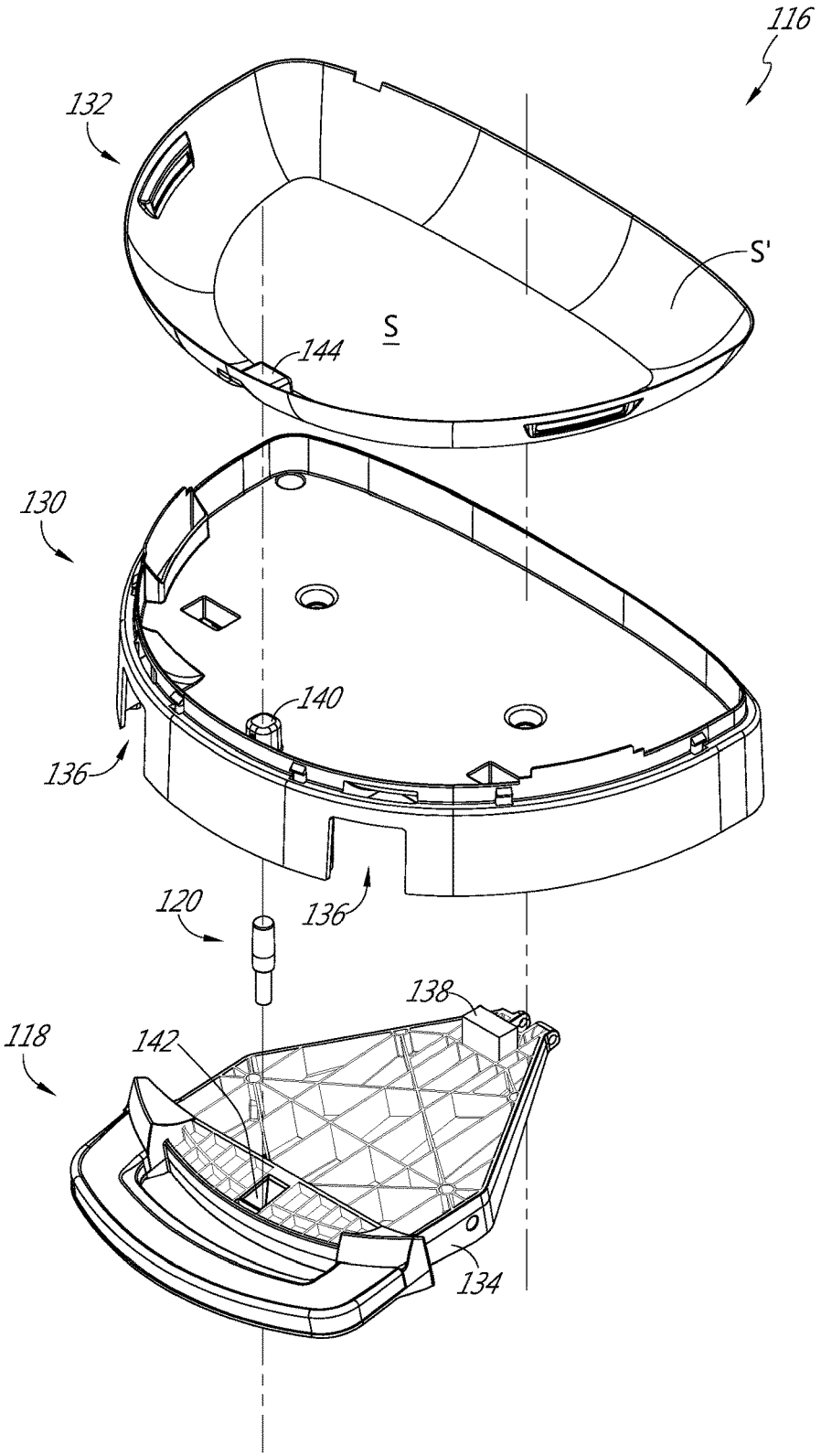
FIG. 9 illustrates a perspective exploded view of a base unit of the receptacle assembly of FIG. 2.

As illustrated in FIG. 9, the base unit 116 can include a lower base portion 130 and an upper base portion 132. In some embodiments, the lower base portion 130 and the upper base portion 132 are unitary components (e.g., are integrally formed). In certain variants, the lower base portion 130 and the upper base portion 132 are separate components. The lower base portion 130 and the upper base portion 132 can be connected together, such as with fasteners, mating hooks and slots, or otherwise. The lower base portion 130 can include feet or other features to enable the receptacle assembly 110 to rest stably on a floor or other generally horizontal surface. As described in more detail below, the lower base portion 130 can engage with the foot pedal 118.

The upper base portion 132 can include a generally upwardly facing surface S, which can form the bottom boundary of the chamber C that can receive a trash bag. As shown, the surface S can be generally concave or generally bowl-shaped. For example, as shown, the surface S can comprise a generally sloped or slanted region (e.g., positioned generally on or around the periphery) and/or a generally flat or generally planar region (e.g., positioned generally horizontally in a central or inner area). In some embodiments, the surface S is free of moving components (e.g., dampers, foot pedal components, cross bars, linkage rods, etc.) and/or substantial bumps, protrusions, recesses, and/or other features that produce appreciable unevenness.

The surface S can be configured to support and/or inhibit damage to a trash bag in the chamber C. For example, the surface S can be configured to reduce the chance of snagging, rubbing, and/or pinching the trash bag, which could tear or otherwise harm the trash bag. In some embodiments, the surface S is substantially continuous and/or provides substantially constant support for the bottom of the trash bag from one lateral side of the chamber C to an opposite lateral side of the chamber C. In certain variants, the surface S is generally smooth, generally continuous, and/or generally unobstructed. In some embodiments, the surface S facilitates a generally even distribution of articles (such as trash) inside of the trash bag about the interface between the surface S and the trash bag.

In certain variants, a rear portion of the surface S comprises a rear corner S'. The rear corner S' can extend along a rear portion of the chamber C of the receptacle assembly 110. As shown in FIG. 9, the rear corner S' can be rounded. For example, as shown, the rear corner S' can comprise a substantially continuous curve from one lateral side of the chamber C to an opposite lateral side of the chamber C. In some implementations, the rear corner S' is generally smooth, generally continuous, and/or generally unobstructed. For example, in some variants, the rear corner S' does not include an upward and/or radially inward projection (such as a projection to make room for a damper located below beneath the projection). The lack of such a projection can, for example, provide additional room for the trash bag to expand in the chamber C and/or can reduce the chance of damage to the trash bag.

In some embodiments, the height of the lower base portion 130 is less or substantially less than the height of the upper base portion 132. In certain variants, the uppermost surface of the lower base portion 130 is closer to the bottom of the receptacle assembly 110 than to the middle and/or top of the receptacle assembly 110. In some embodiments, the height of the lower base portion 130 is less than or equal to about one-fourth of the height of the upper base portion 132. In certain embodiments, the height of the lower base portion 130 is less than or equal to about one-eighth of the height of the upper base portion 132.

4B. Foot Pedal

As previously mentioned, the receptacle assembly can include an actuator, such as a foot pedal 118. In some embodiments, the foot pedal 118 can include a pedal bar 134 that couples with the lower base portion 130. For example, the pedal bar 134 can be pivotally coupled with the lower base portion 130 such that at least the front portion of the pedal bar 134 can be pivoted relative to the lower base portion 130 (e.g., to enable a user to press on and move the front portion of the pedal). As shown, the pedal bar 134 can extend out from a front region of the lower base portion 130 so as to provide access by a user's hand or foot. For example, the pedal bar 134 can extend through apertures 136 in the lower base portion 130.

As previously mentioned, the foot pedal 118 can be operatively connected with the lid unit 114 with a linkage, such as the rod 126. When the foot pedal 118 is moved from a resting position to an actuated position, the lid 122 can be moved from the closed position to the open position. As used herein, the term "resting position" refers to a position in which the foot pedal 118 normally resides when not being actuated by a user, such as when a front portion of the foot pedal 118 is pivoted towards an upper position. As used herein, the term "actuated position" refers to a position in which the pedal 118 is located during or upon completion of actuation by a user, such as when a front portion of the foot pedal 118 is pressed downward by a user. In various embodiments, in response to the front portion of the foot pedal 118 being depressed, the rear portion of the pedal bar 134 can pivot upward, which can move the rod 126 generally upward, which in turn can drive the lid 122 toward the open position. In various embodiments, in response to the front portion of the foot pedal 118 being released, the weight of the lid unit 114 can encourage the lid 122 to move toward the closed position, which can move the rod generally downward, which in turn can pivot the rear portion of the pedal bar 134 downward and/or the front portion of the pedal bar 134 upward.

In certain implementations, the lid 122 and/or the foot pedal 118 are biased toward the closed and resting positions, respectively, by way of various devices or configurations. For example, the force of gravity and/or the weight of the lid 122 can encourage the lid 122 toward the closed position, such as when a user has released the pedal 118 or otherwise is applying substantially no downward force on the foot pedal 118. Some embodiments include springs or other force-providing members to bias the lid 122 toward the closed position, and/or the foot pedal 118 to the resting position.

As shown, the pedal bar 134 can include a movement control element, such as a stop block 138. The stop block 138 can be located on the rear portion of the pedal bar 134. When the foot pedal is depressed, the stop block 138 can engage with (e.g., abut against) the upper base portion 132, which can inhibit or prevent further upward movement of the rear portion of the pedal bar 134. In some embodiments, the movement control element includes a dampening feature, such as a rubber bumper, which can reduce the impact with which the stop block 138 contacts the upper base portion 132 and/or can reduce the amount of noise created by such impact.

4C. Motion Damper

As shown in FIGS. 10A-11C, the base unit 116 can include the motion damper 120. The motion damper 120 can be any type of dampening device, rotary dampening device, friction dampening device, fluid dampening device with liquid or gaseous working fluids (e.g., an air damper), biasing member (e.g., a spring), or otherwise. In some embodiments, the motion damper 120 comprises a linear dampening device, such as a device than extends and contracts along a straight line. In some embodiments, the motion damper 120 comprises a single-directional fluid (e.g., air or hydraulic) damper that is configured to slow down linear movement before reaching a final position and/or to provide a controlled return to a starting position. The motion damper 120 can include a housing with an inner cavity, a piston that reciprocates in the cavity, and a connecting rod coupled with the piston. Fluid pressure in the cavity can inhibit movement of the piston, thereby providing a dampening influence. In certain embodiments, the motion damper 120 comprises a Titus damper, such as Item No. 960-0378, available from TitusPlus or Titus Tool Co. Inc. In some implementations, at a temperature of about 20° C., the motion damper 120 operates with a dynamic force of about 200N±30N and/or a velocity of less than or equal to about 740 mm/min. Further details about the motion damper 120 and other features can be found in U.S. Pat. No. 8,418,869, issued Apr. 16, 2013, the entirety of which is hereby incorporated by reference herein.

The motion damper 120 can be configured to dampen and/or regulate the movement of one or more of the components of the receptacle assembly 110. For example, the motion damper 120 can dampen (e.g., slow and/or control) movement of the lid 122 between the open and closed positions, such as from the open position toward the closed position and/or from the closed position toward the open position. In some embodiments, when the lid 122 is in the open position and the user releases the front portion of the foot pedal 118, the weight of the lid 122 and/or the front portion of the foot pedal 118 can encourage the lid unit 114 to move toward the closed position. This can cause the foot pedal 118 to move, which can cause the motion damper's piston to move in the chamber and be inhibited by fluid pressure, thereby causing the foot pedal's movement to be dampened. Such dampening can be transmitted, via the rod 126, from the foot pedal 118 to the lid unit 114. This can provide graceful and controlled movement of the lid 122 and/or can reduce or eliminate an audible noise (e.g., clanging) when the lid 122 closes against the body unit 112.

In certain embodiments, the motion damper 120 is a one-way damper, which provides dampening in only one direction. For example, in some embodiments, the motion damper 120 provides dampening only during a closing movement of the lid 122. In certain variants, the motion damper 120 provides dampening only during an opening movement of the lid 122. In some variants, the motion damper 120 is a two-way damper, which provides dampening when the lid 122 is moved from the closed position toward the open position and from the open position toward the closed position. In some implementations, the motion damper 120 is configured to provide more resistance (e.g., dampening force) when the lid 122 is being closed than when the lid 122 is being opened.

Figure 10A:
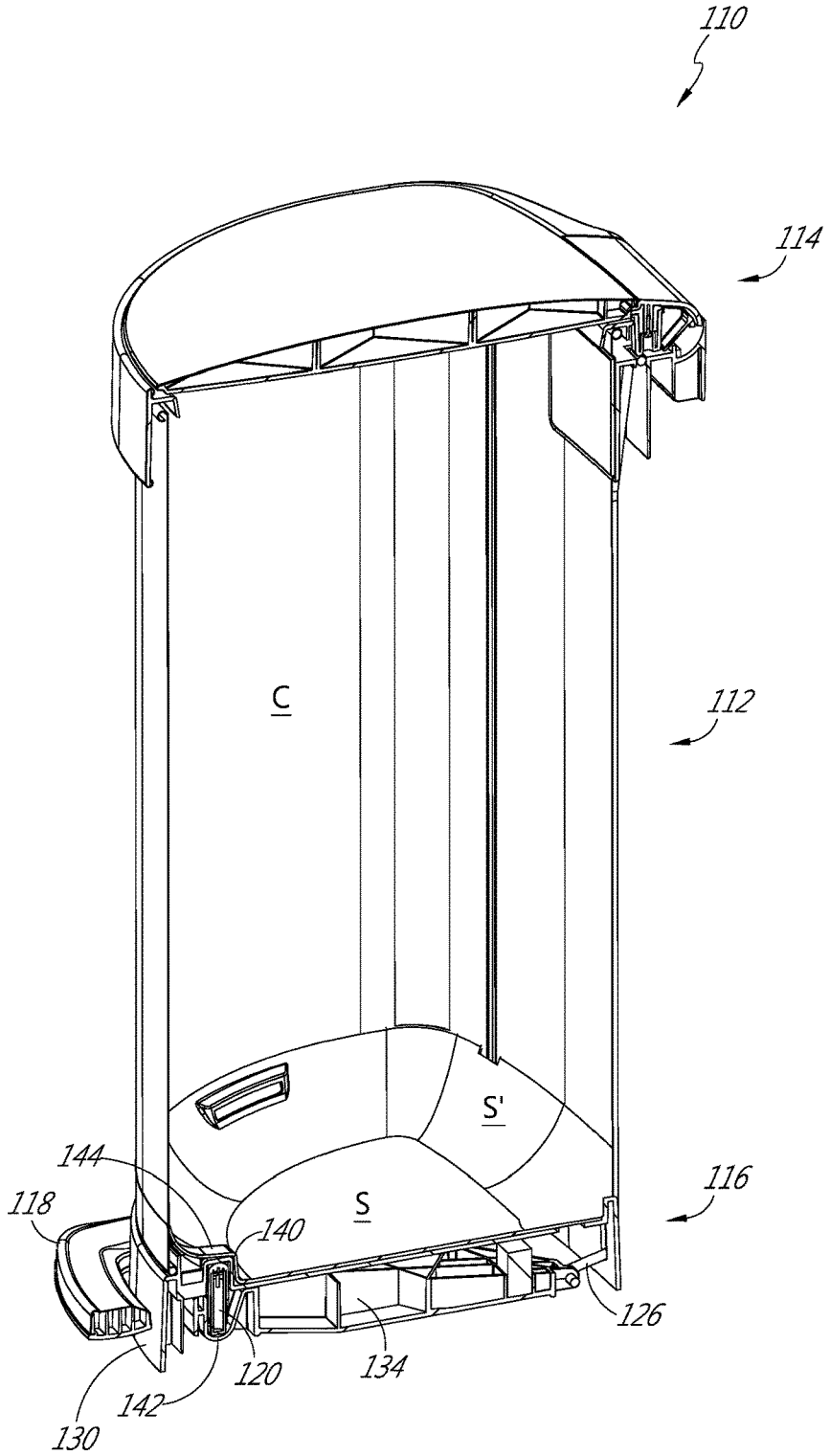
FIGS. 10A and 10B respectively illustrate perspective and side cross-sectional views of the receptacle assembly of FIG. 2.
Figure 10B:
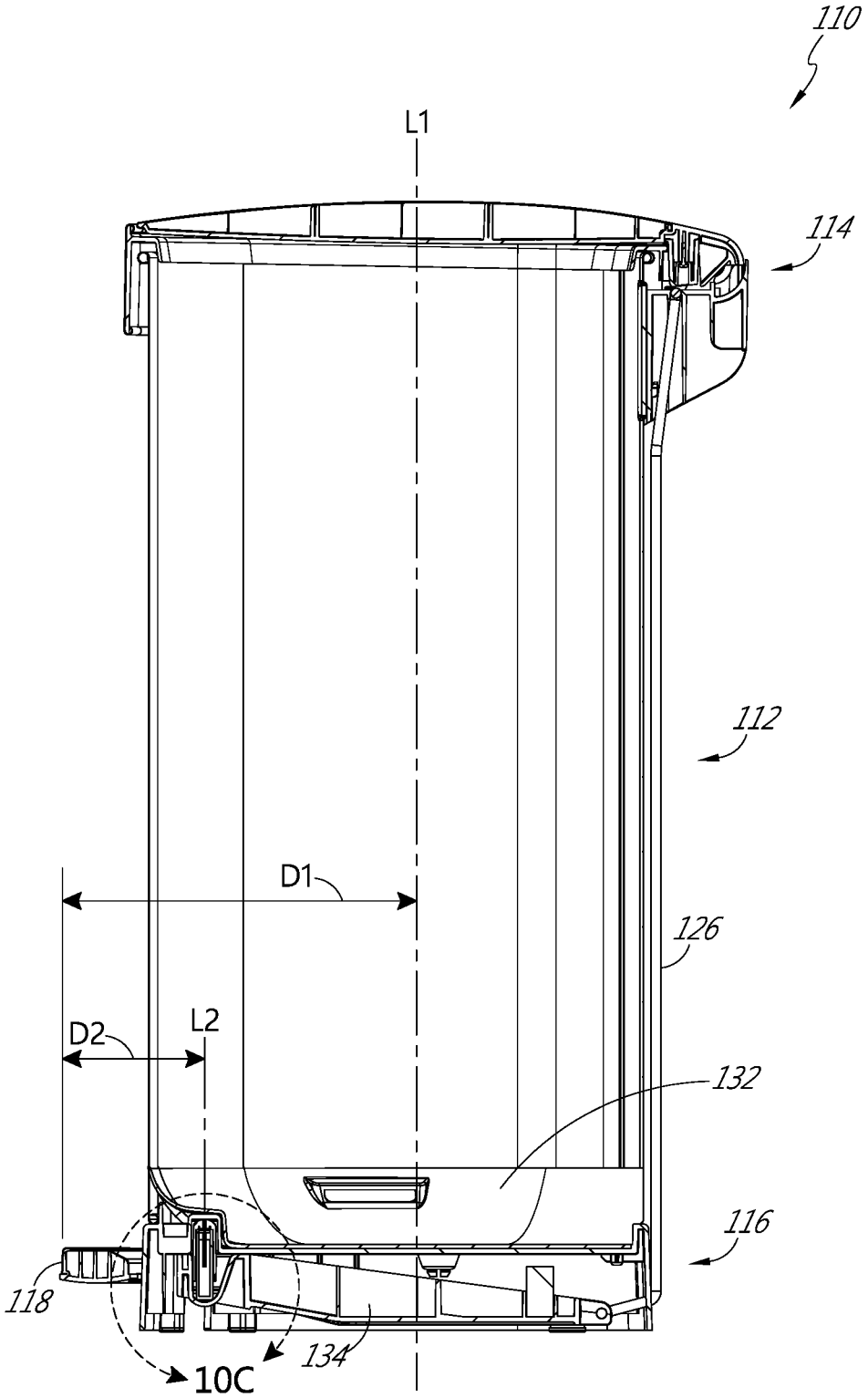
Figure 11A:
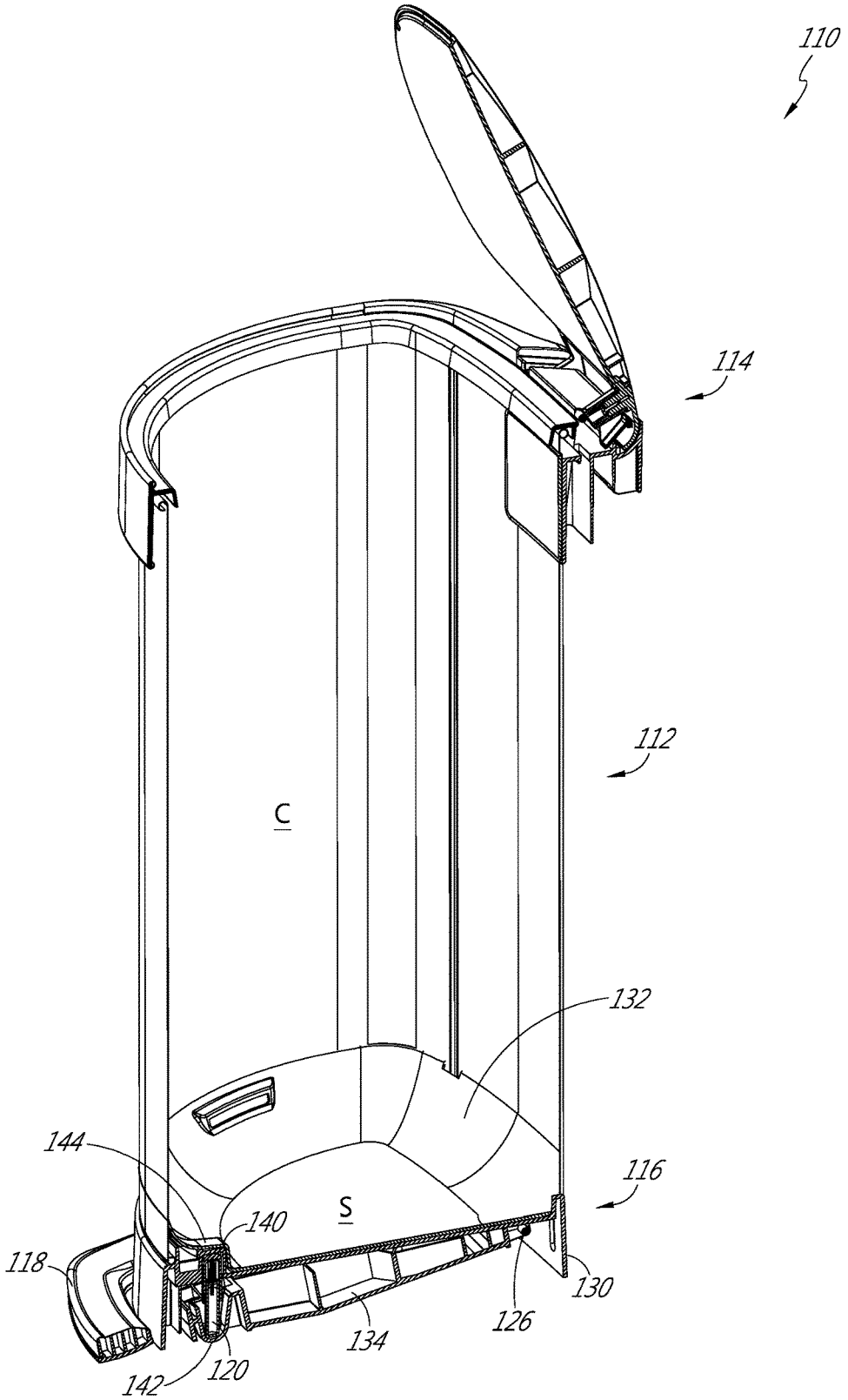
FIGS. 11A and 11B respectively illustrate perspective and side cross-sectional views of the receptacle assembly of FIG. 3.
Figure 11B:
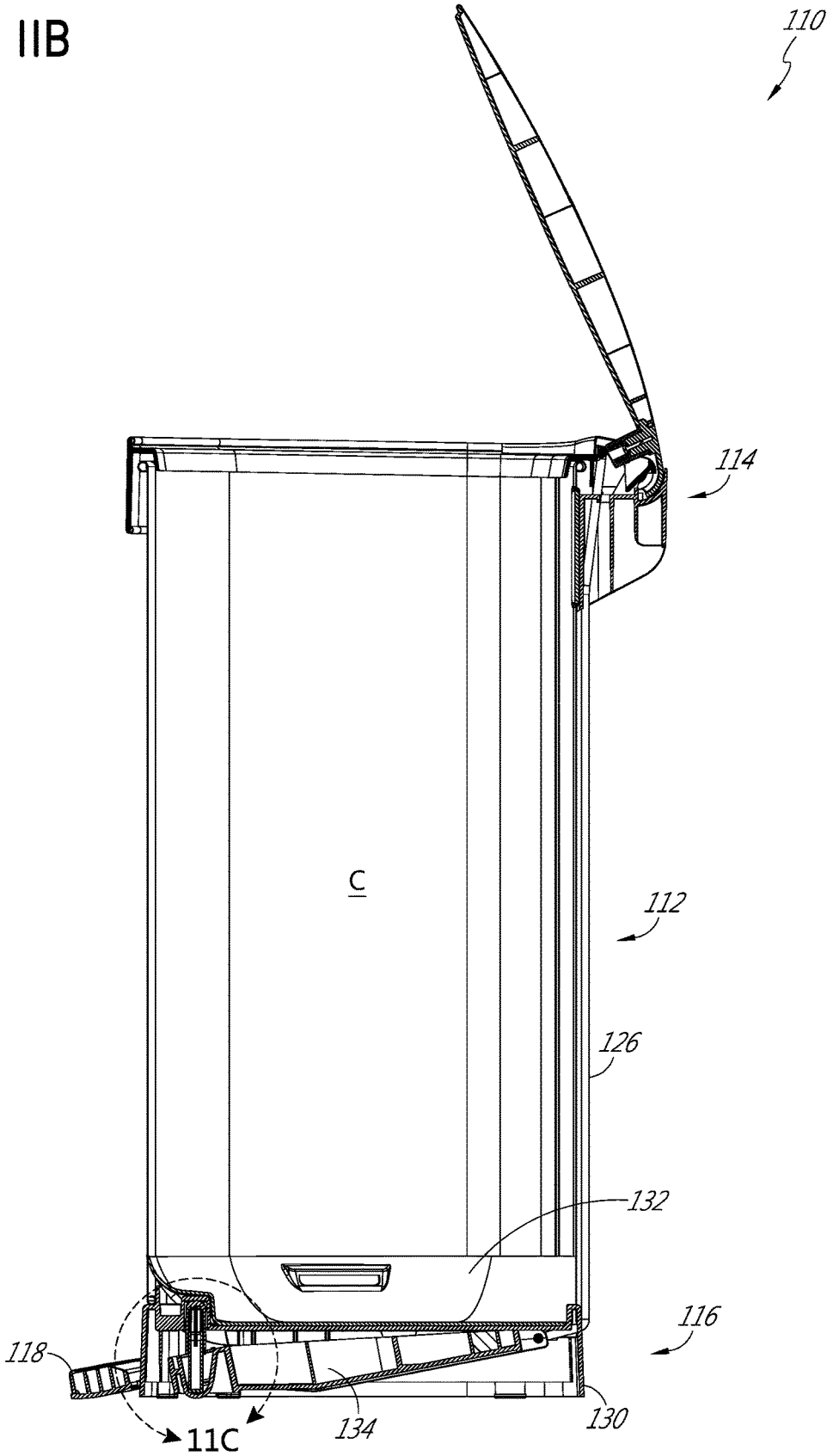
Figure 11C:
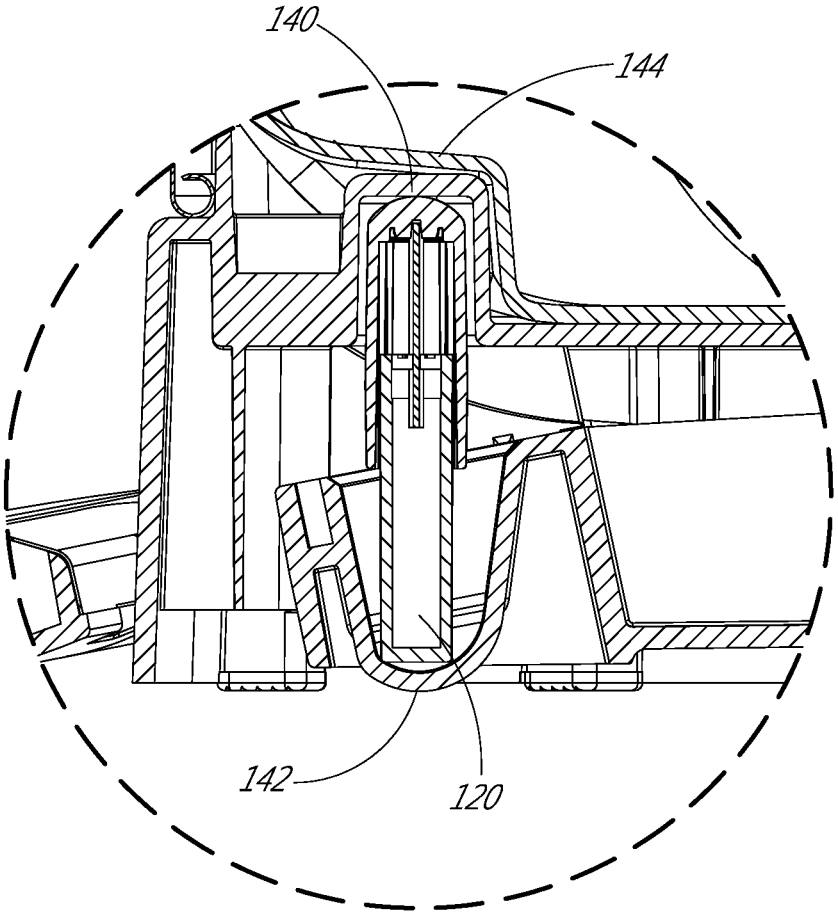
FIG. 11C illustrates a close-up view of a portion of FIG. 11B.
Figure 12:
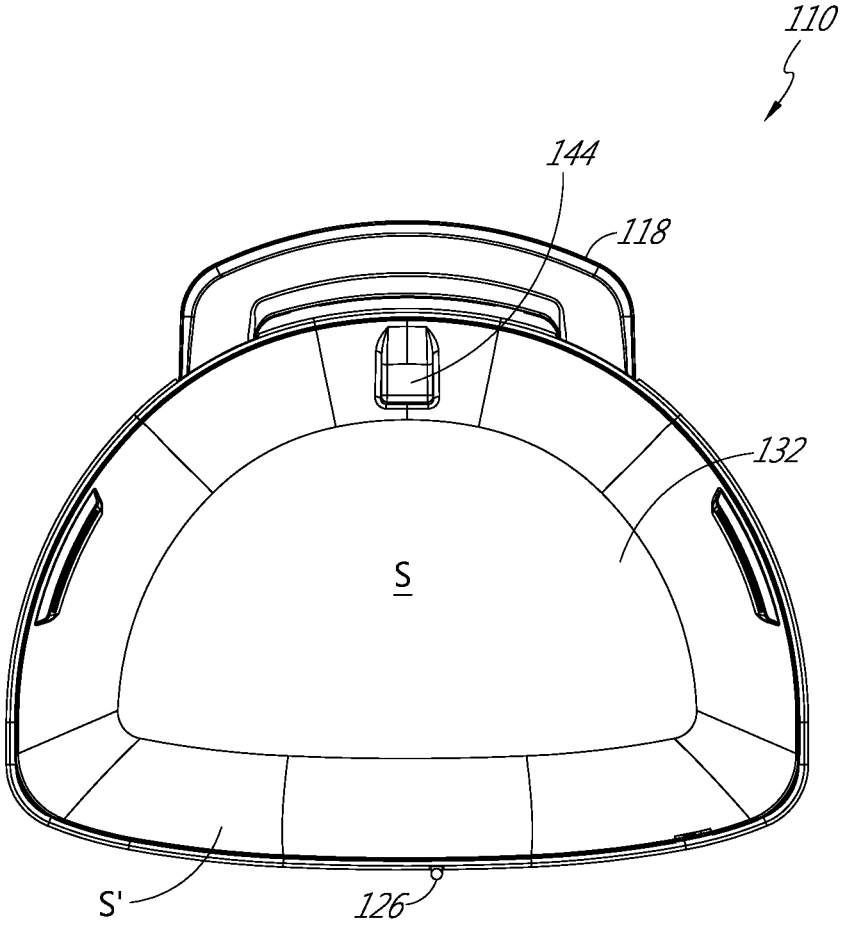
FIG. 12 illustrates a cross-sectional view along the line 12-12 of FIG. 5.

As shown in FIGS. 10B and 11B, a first (e.g., upper) end of the motion damper 120 can be engaged with the lower or upper base portion 130, 132 and a second (e.g., lower) end of the motion damper 120 can be engaged with the foot pedal 118. For example, the first end of the motion damper 120 can be received in a recess 140 in the lower base portion 130 and the second end of the motion damper 120 can be received in a recess 142 in the foot pedal 118. In some implementations, when the foot pedal 118 is in the resting position, a majority of the motion damper 120 is received in the recess 140 in the lower base portion 130. In certain variants, when the foot pedal 118 is in the resting position, a majority of the motion damper 120 is received in the recess 142 in the foot pedal 118. In some implementations, in a vertical plane intersecting the motion damper 120, lower base portion 130, and foot pedal 118, the motion damper 120 is positioned between the lower base portion 130 and foot pedal 118. For example, the motion damper 120 can be sandwiched by the lower base portion 130 and foot pedal 118.

As illustrated, the motion damper 120 can be positioned above the foot pedal 118. For example, a lowest portion (e.g., the second end) of the motion damper 120 can be above a portion (e.g., the base of the recess 142) of the foot pedal 118 and/or an upper portion (e.g., the first end) of the motion damper 120 can be positioned below a portion (e.g., the base of the recess 140) of the lower base portion 130. In certain variants, the motion damper 120 does not engage the rod 126, such as via a bracket. In some embodiments, the motion damper 120 directly engages the foot pedal 118. For example, the motion damper 120 can directly dampen movement of the foot pedal 118, rather than dampening movement of the rod to indirectly dampen movement of the foot pedal.

In some embodiments, the first end of the motion damper 120 remains substantially stationary relative to the lower base portion 130 and the second end of the motion damper 120 is configured to move relative to the foot pedal 118. For example, when the foot pedal 118 is depressed by a user, the second end of the motion damper 120 can slide along a portion of the recess 142 in the foot pedal 118. In certain variants, the second end of the motion damper 120 remains substantially stationary relative to the foot pedal 118 and the first end of the motion damper 120 is configured to move relative to the lower base portion 130. In some embodiments, one or both ends of the motion damper 120, the base of the recess 140, and/or the base of the recess 142 are rounded (e.g., hemispherical). This can facilitate movement of the motion damper 120 relative to the foot pedal 118.

Figure 10C:
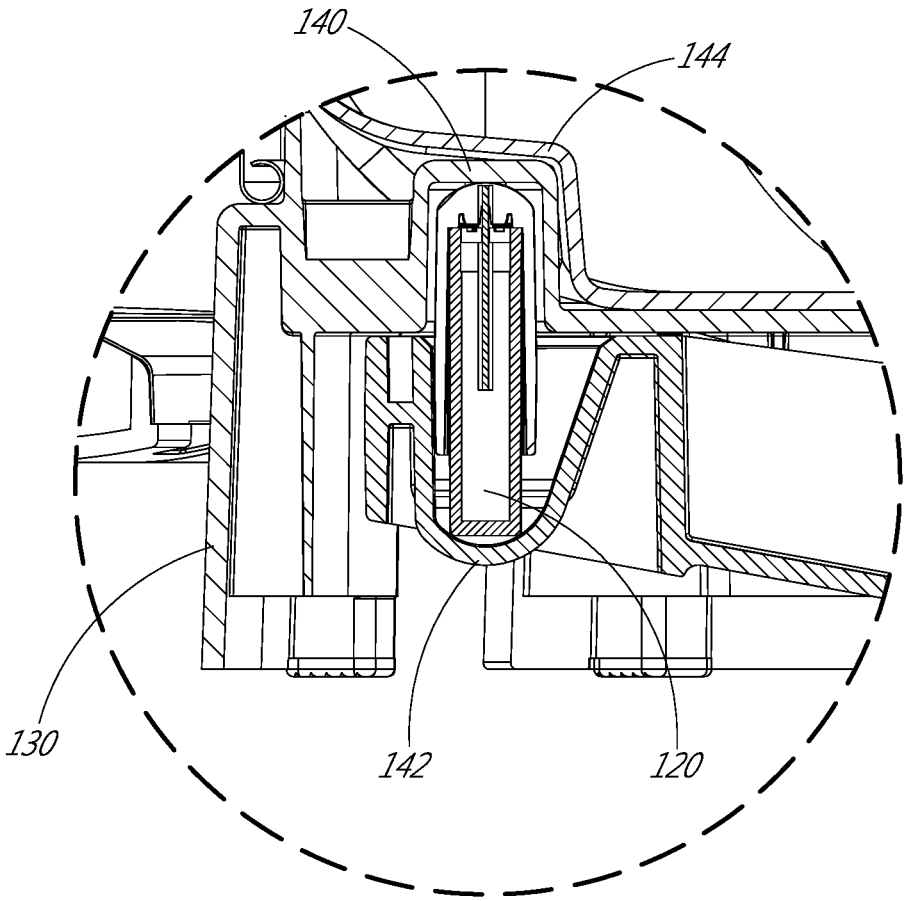
FIG. 10C illustrates a close-up view of a portion of FIG. 10B.

As shown in FIGS. 10B and 10C, in some embodiments, when the foot pedal 118 is in the resting position, the motion damper 120 is substantially completely bounded by the foot pedal 118 and the lower base portion 130. For example, the motion damper 120 can be completely or substantially completely enclosed within, surrounded by, and/or encapsulated between the foot pedal 118 and the lower base portion 130. The motion damper 120 being substantially completely bounded can support the motion damper 120, maintain the motion damper 120 in position, protect the motion damper 120 from dirt and damage, and/or aid in hiding the motion damper 120 from view.

Certain embodiments are configured to compensate for and/or offset the length of the motion damper 120. For example, in some implementations, the sum of the depth of the recess 140, 142 is greater than or equal to the longitudinal length of the housing of the motion damper 120. In some embodiments, the motion damper 120 does not increase the height of the base unit 114 and/or the receptacle assembly 110 overall.

In some embodiments, the motion damper 120 is positioned between the base of the recess 140 and the base of the recess 142. For example, the motion damper 120 can span the length between such bases. The motion damper 120 can be configured to expand and contract to adjust for movement of the bases. For example, when the front portion of the foot pedal 118 is depressed by a user, the front portion of the foot pedal 118 pivots downward. This can move the front portion of the foot pedal 118 away from the upper base portion 132, which moves the base of the recess 142 away from the base of the recess 140. The motion damper 120 can increase in length a corresponding amount to continue to span between the bases. When the front portion of the foot pedal 118 is released by a user, the front portion of the foot pedal 118 can pivot upward, which moves the front portion of the foot pedal 118 toward the upper base portion 132 and moves the base of the recess 142 toward the base of the recess 140. The motion damper 120 can decrease in length a corresponding amount to continue to span between the bases.

The motion damper 120 can be located near the front wall F of the receptacle assembly 110. For example, as shown in FIG. 10B, the motion damper 120 can be positioned closer to a front wall of the body portion than to a rear wall of the body portion. The motion damper 120 can be positioned adjacent or directly adjacent the front wall of the body portion. In certain embodiments, the motion damper 120 is positioned closer to the frontmost portion of the foot pedal 114 than the rearmost portion of the foot pedal 114. As a function of the front-to-rear width of the body unit 112, the motion damper 120 can be located in the front half, front third, front quarter, front eighth, front sixteenth, or otherwise. In some implementations, the motion damper 120 is not connected with a rear portion of the receptacle assembly, such as not being fastened to a rear wall of the body unit 112. In certain variants, the motion damper 120 is not located in, and/or does not extend into, the chamber C. In some embodiments, the motion damper 120 is not connected to a top of the base unit 116 and/or is not exposed in the chamber C. In some implementations, the motion damper 120 is located inside the base unit 116 and/or is not positioned on an exterior surface of the receptacle assembly 110.

The motion damper 120 can be positioned frontward of a center of the receptacle assembly 110. As illustrated in FIG. 10B, the receptacle assembly 110 can have a longitudinal axis L1 (which is spaced apart from the frontmost portion of the foot pedal 118 by a distance D1) and the motion damper 120 can have a longitudinal axis L2 (which is spaced apart from the frontmost portion of the foot pedal 118 by a distance D2). The distance D1 can be substantially greater than the distance D2. For example, the ratio of D1 to D2 can be at least about: 2.0, 2.25, 2.5, 2.75, 3.0, ratios between the aforementioned ratios, or other ratios. As can be seen in FIG. 10B, the longitudinal axis L2 of the motion damper 120 can be generally parallel with the longitudinal axis L1 of the receptacle assembly 110. In some variants, the longitudinal axis L2 is less than or equal to about 5° from exactly parallel with the longitudinal axis L1. As can be seen in FIG. 10B, in certain embodiments the distance between the motion damper 120 and the front wall F of the body 112 is less than or equal to the distance from the front of the foot pedal 118 to the front wall F of the body 112. In some embodiments, the distance between the motion damper 120 and the front wall F of the body 112 is less than or equal to the distance from the top of the foot pedal 118 to the bottom of the base unit 116 and/or the amount of travel of the front of the foot pedal 118 between the resting and actuated positions.

Locating the motion damper 120 near the front F of the receptacle assembly 110 can have certain benefits. For example, compared to some trash cans with dampers located at a rear of the trash can (e.g., on a rear wall of the trash can), locating the motion damper 120 near the front F of the receptacle assembly 110 can increase the length of travel of the motion damper 120 as the lid 122 moves between the open and closed positions. This increase in length can allow the motion damper 120 to counteract the motion of the foot pedal over a longer distance, which can reduce stress on the motion damper 120, can allow the damper to provide an increased dampening force, and/can enable higher resolution of dampening on the foot pedal 118.

In some embodiments, the motion damper 120 is located in a lateral middle region of the receptacle assembly 110. For example, the motion damper 120 can be located on or near a midpoint of the distance between lateral sidewalls of the body unit 112. As illustrated in FIG. 9, the motion damper 120 can be positioned at or near a lateral middle of the foot pedal 118, such as a lateral middle of a front support section that is contained within the lower base portion 130. This can reduce twisting or rocking of the foot pedal 118 during dampening, facilitate protecting the motion damper 120, or otherwise. As shown, the front support section, or other portions of the foot pedal 118, can include reinforcement members, such as ribs, struts, or otherwise. In some variants, from a top plan view, the reinforcement members form spaces that hexagonal, rectangular, triangular, or another shape. This can reduce the weight of, and/or the amount of material in, the foot pedal 118.

Certain embodiments are configured to protect, conceal, or obscure the motion damper 120. For example, the motion damper 120 can be positioned entirely inside the base unit 116, which can shield the motion damper 120 and reduce the chance of the motion damper 120 being damaged. As mentioned above, the motion damper 120 can be located under the upper base portion 132 and/or the lower base portion 130. This can protect the motion damper 120 from damage when trash is thrown into a trash bag in the chamber C. In some embodiments, the motion damper 120 is not visible to, and/or accessible by, a user during normal use of the receptacle assembly 110. For example, the motion damper 120 is hidden when the receptacle assembly 110 is viewed from the external front, rear, side, and top (see, e.g., FIGS. 2-7). In certain embodiments, the motion damper 120 is hidden when a user looks down into the interior of the chamber C (see FIG. 12), such as when the user is removing and/or replacing the trash bag. Thus, in some embodiments, the motion damper 120 is hidden both internally and externally.

As illustrated, some embodiments include a single motion damper 120. Some embodiments include a plurality of motion dampers 120, such as two, three, four, or more. For example, certain variants have a first motion damper on a first lateral side of the foot pedal 118 and a second motion damper on a second lateral side of the foot pedal 118. Certain embodiments have multiple motion dampers positioned within the footprint of the foot pedal 118. For example, a plurality of motion dampers can be located on a front-to-rear centerline of the foot pedal 118.

Figure 5:
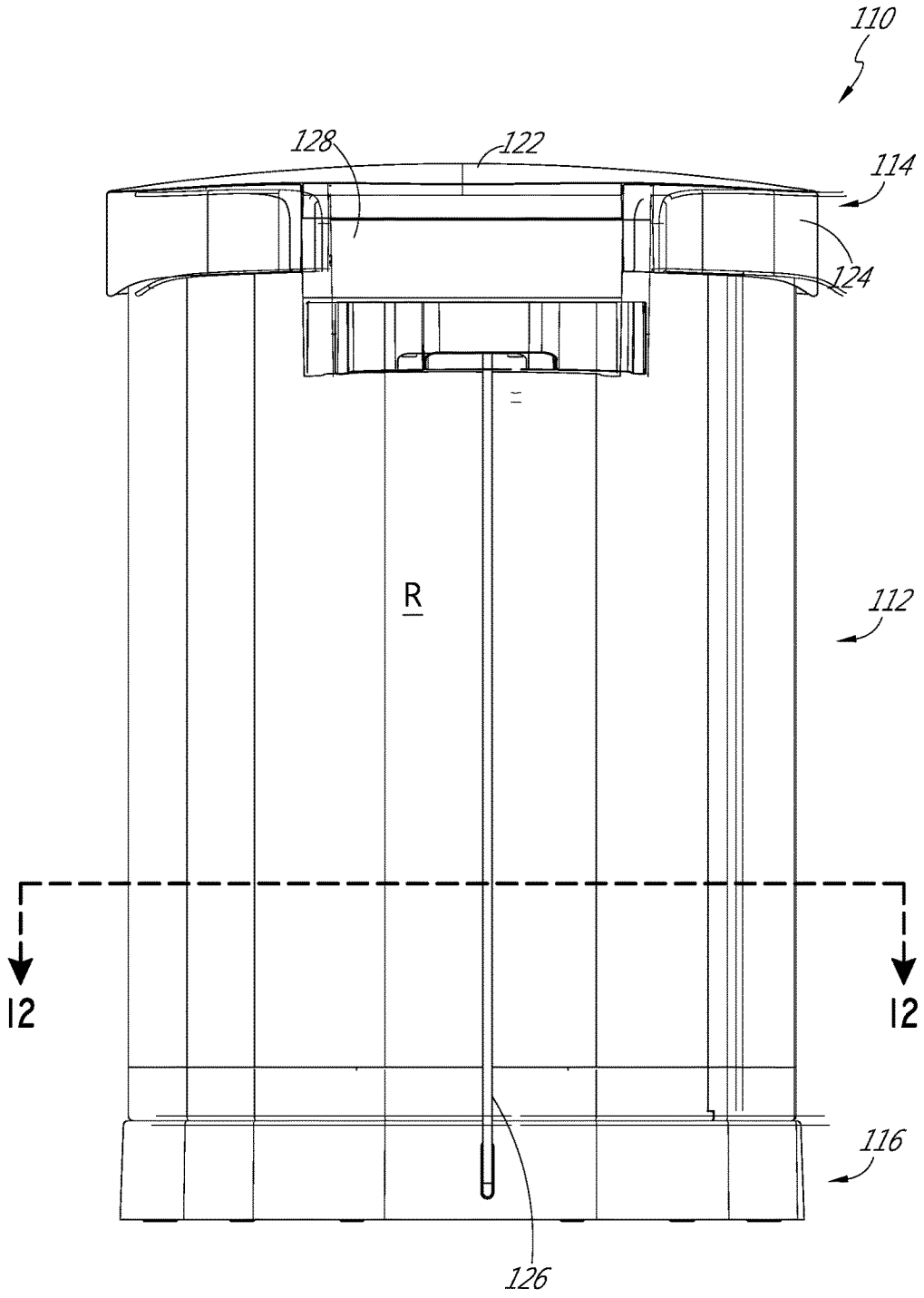
FIG. 5 illustrates a rear elevation view of the receptacle assembly of FIG. 2.
Figure 6:
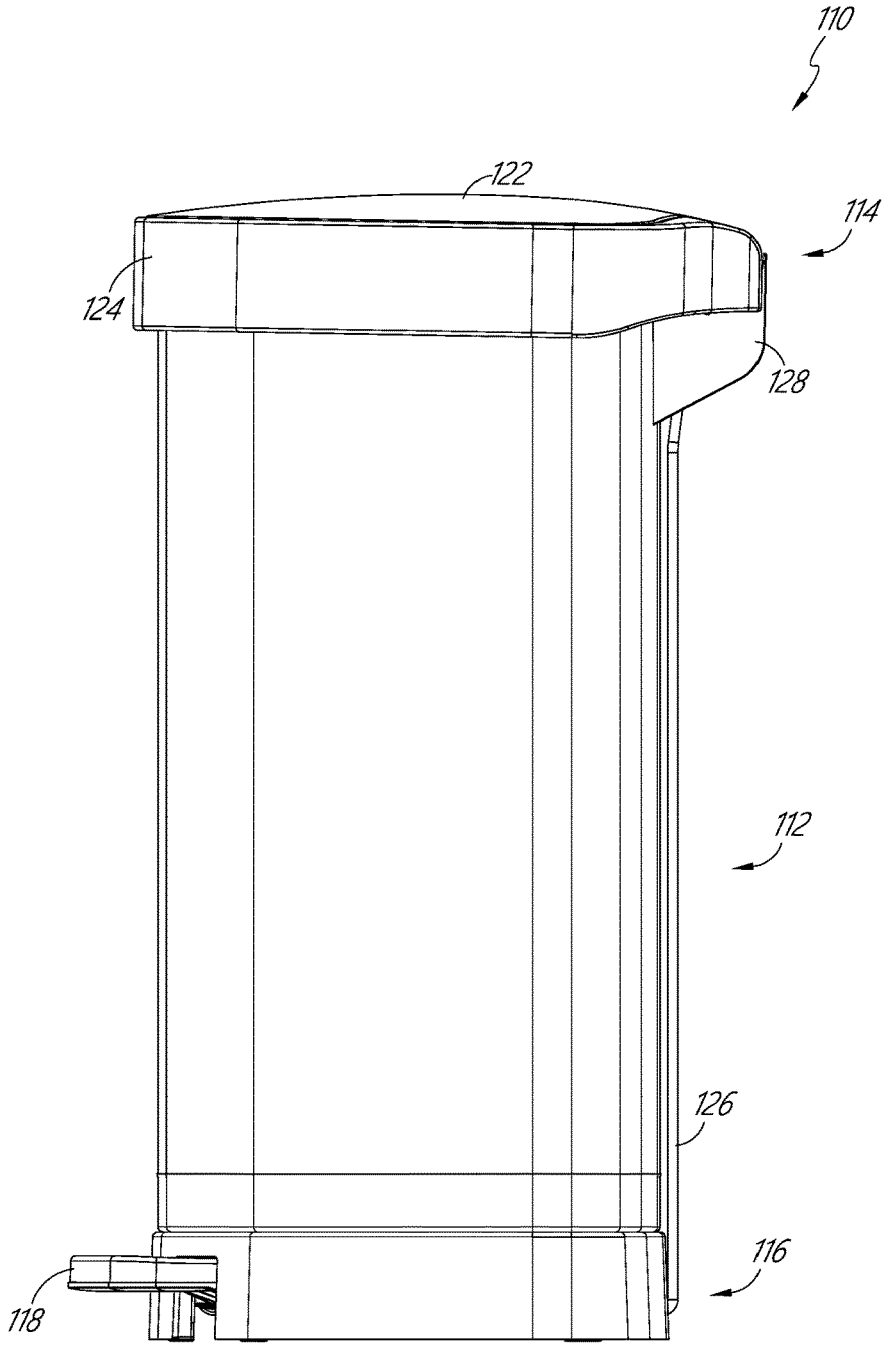
FIG. 6 illustrates a left-side elevation view of the receptacle assembly of FIG. 2, the right side being a mirror image.
Figure 7:
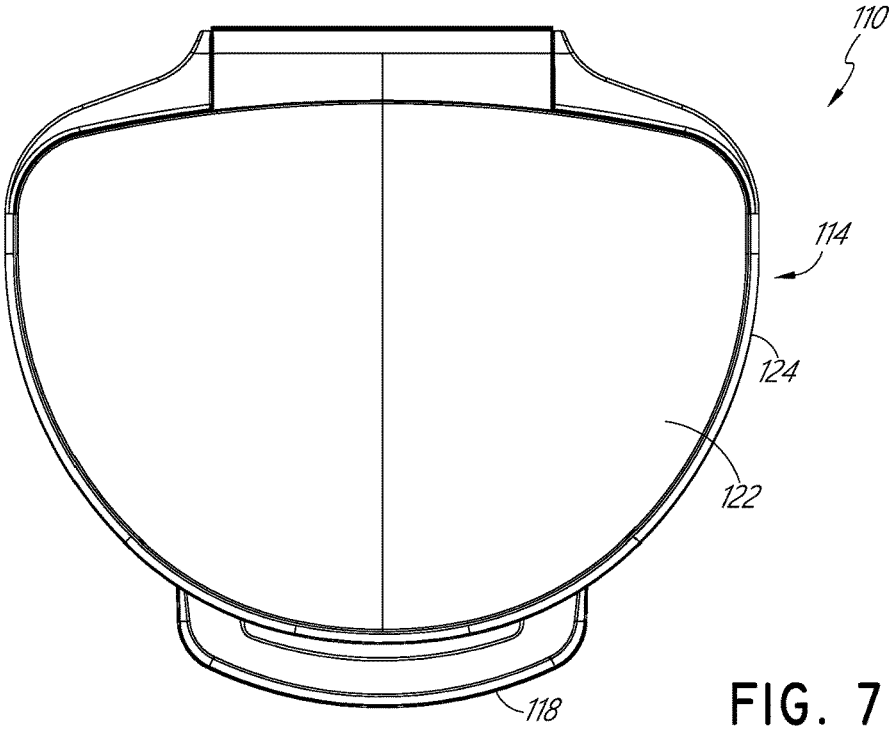
FIG. 7 illustrates a top plan view of the receptacle assembly of FIG. 2.
Figure 8:
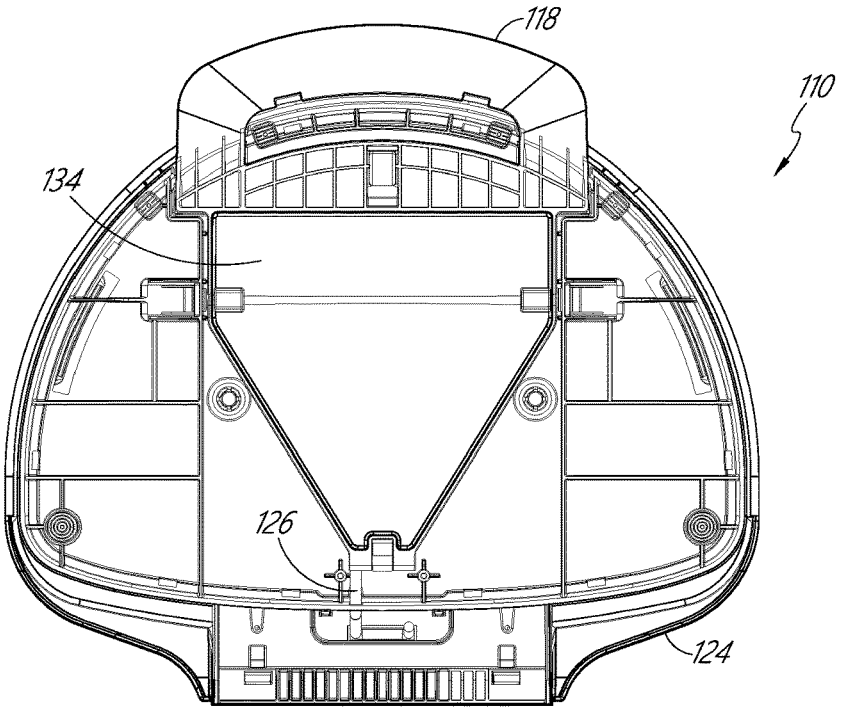
FIG. 8 illustrates a bottom plan view of the receptacle assembly of FIG. 2.

As shown in FIG. 5, the rear wall of the body unit 112 can be substantially continuous and uninterrupted. For example, in some variants, the rear wall of the body unit 112 does not include an opening that permits access to a motion damper 120 and/or a door that covers a motion damper 120. In some embodiments, the rear wall of the body unit 112 includes a single vertical seam (e.g., a seam from ends of sheet metal used to form the body unit 112), yet the rear wall can still be considered to be substantially continuous and uninterrupted.

In some embodiments, an upper part of the recess 140 of the lower base portion 130 can be contained in a protrusion, such as an upwardly extending bulge, as shown in FIG. 10B. The protrusion and/or the first end of the motion damper 120, can be received in a compartment 144 in the upper base portion 132. The compartment 144 can be positioned in the front of the upper base portion 132. As shown, the compartment 144 can project slightly upwardly and inwardly into the chamber C. In certain implementations, the rear of the upper base portion 132 that bounds the chamber C does not include an upward and inward projection. In some embodiments, the compartment 144 extends over and/or shields the motion damper 120. This can inhibit damage to the motion damper 120 and/or separate a trash bag in the chamber C from the motion damper 120, such as to inhibit or prevent the trash bag from contacting the motion damper 120.

As previously mentioned, in some embodiments, the motion damper 120 is received in the recess 140 in the lower base portion 130 and/or the recess 142 in the foot pedal 114. For example, in certain embodiments, the motion damper 120 is secured to the recess with a fastener, adhesive, welding, or otherwise. In some embodiments, the motion damper 120 is received in the recess with an interference fit, which can secure the motion damper 120 in the recess without the need for further securing elements. For example, in certain variants, the motion damper 120 is secured without a fastener, adhesive, or welding. In some implementations, the motion damper 120 is positioned, or secured, without using a bracket.

Various embodiments of the receptacle assembly 110 can facilitate manufacturability. For example, some embodiments do not include a bracket for mounting the motion damper 120 (e.g., to a rear wall). As illustrated, some embodiments have the motion damper 120 mounted and retained between the lower base portion 130 and the foot pedal 118. Thus, the total number of parts can be reduced (e.g., the bracket itself, fasteners for mounting the bracket to the body unit, and fasteners for mounting the bracket to the motion damper 120 can be eliminated). The reduction in parts can reduce ease manufacturability, such as by reducing the number of steps to assemble the receptacle assembly 110.

5. Certain Additional Embodiments

Figure 13:
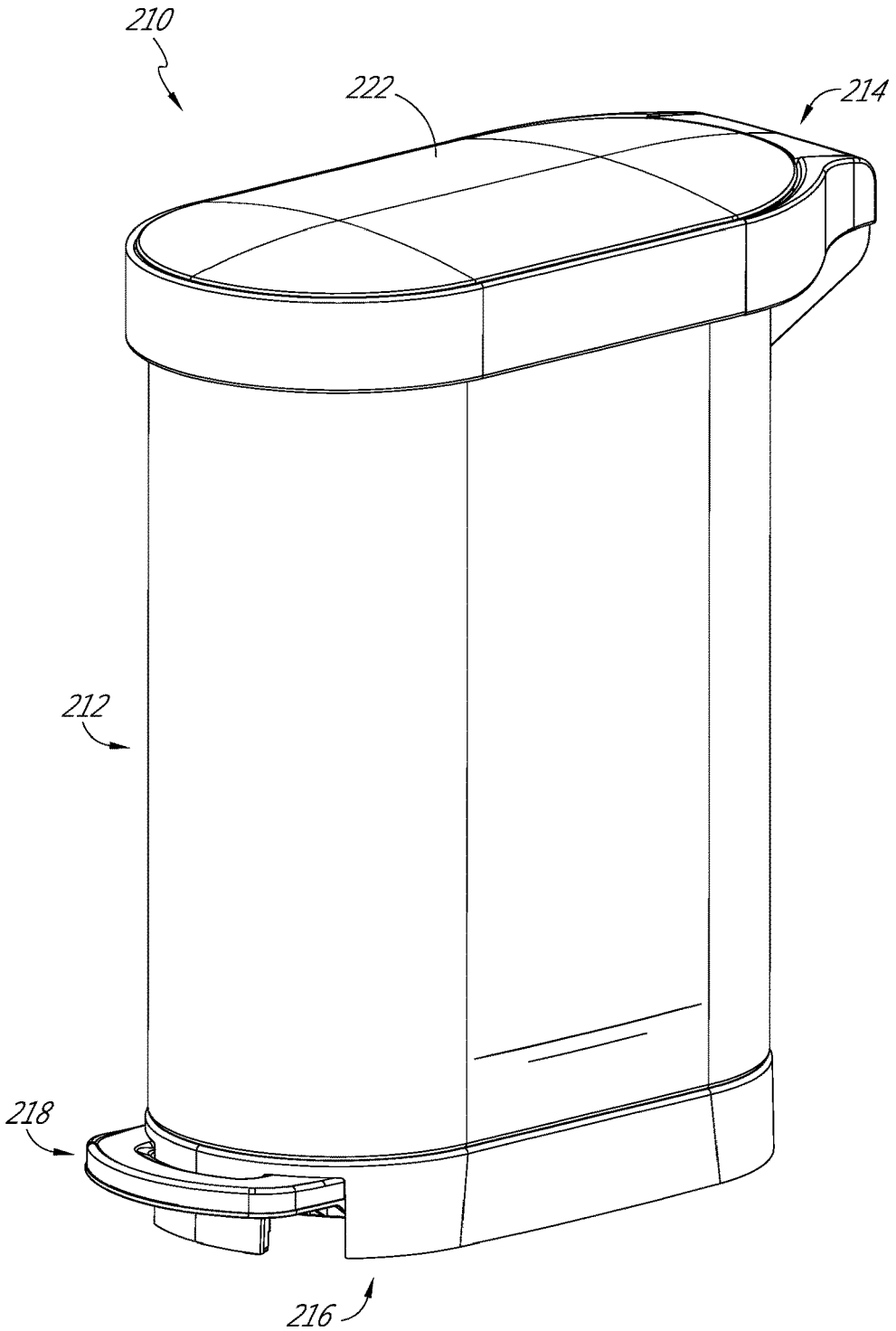
FIG. 13 illustrates a front, top, left side perspective view of another embodiment of a receptacle assembly with a lid in a closed position.
Figure 14:
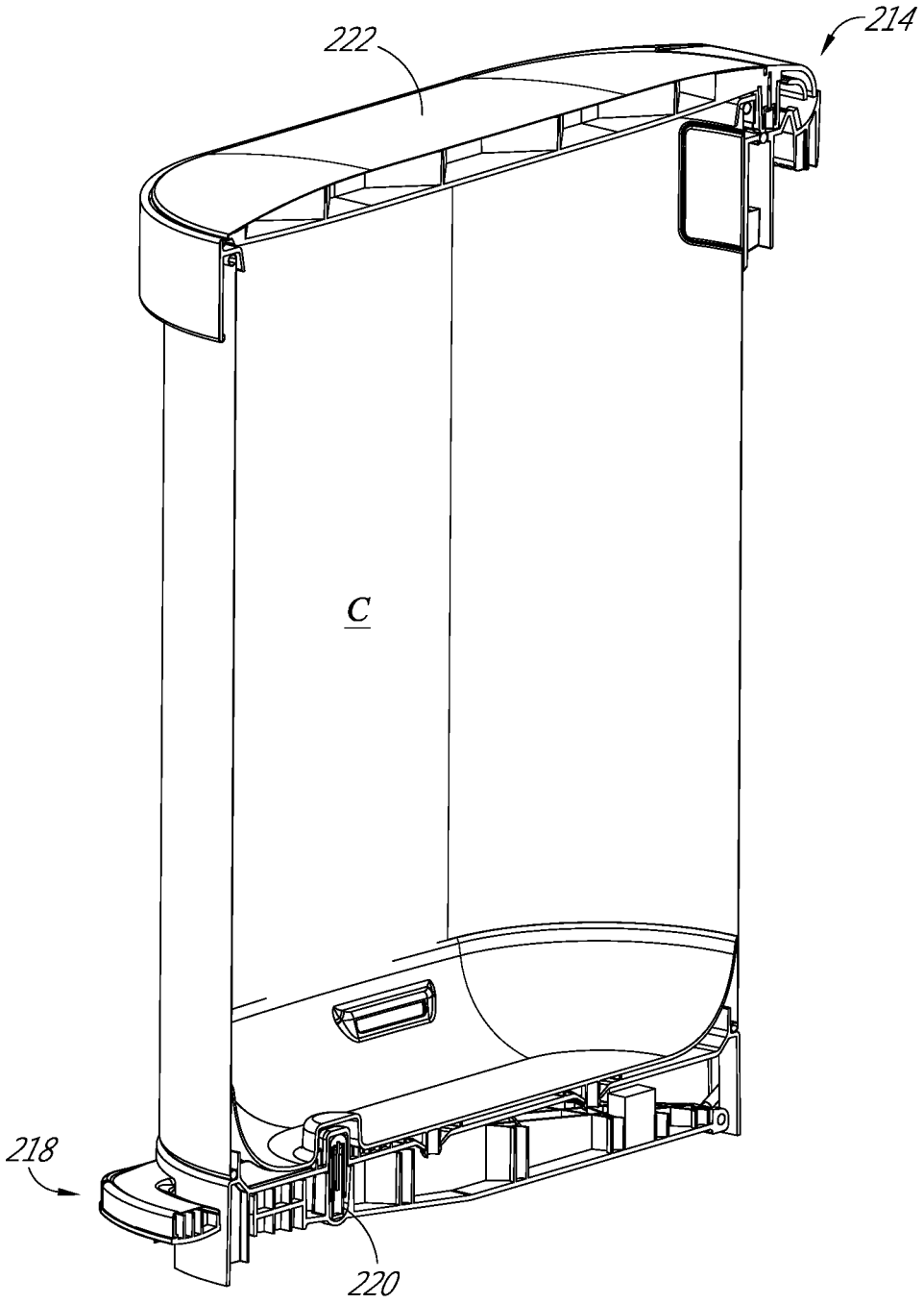
FIG. 14 illustrates a side perspective cross-sectional view of the receptacle assembly of FIG. 13.
Figure 15:
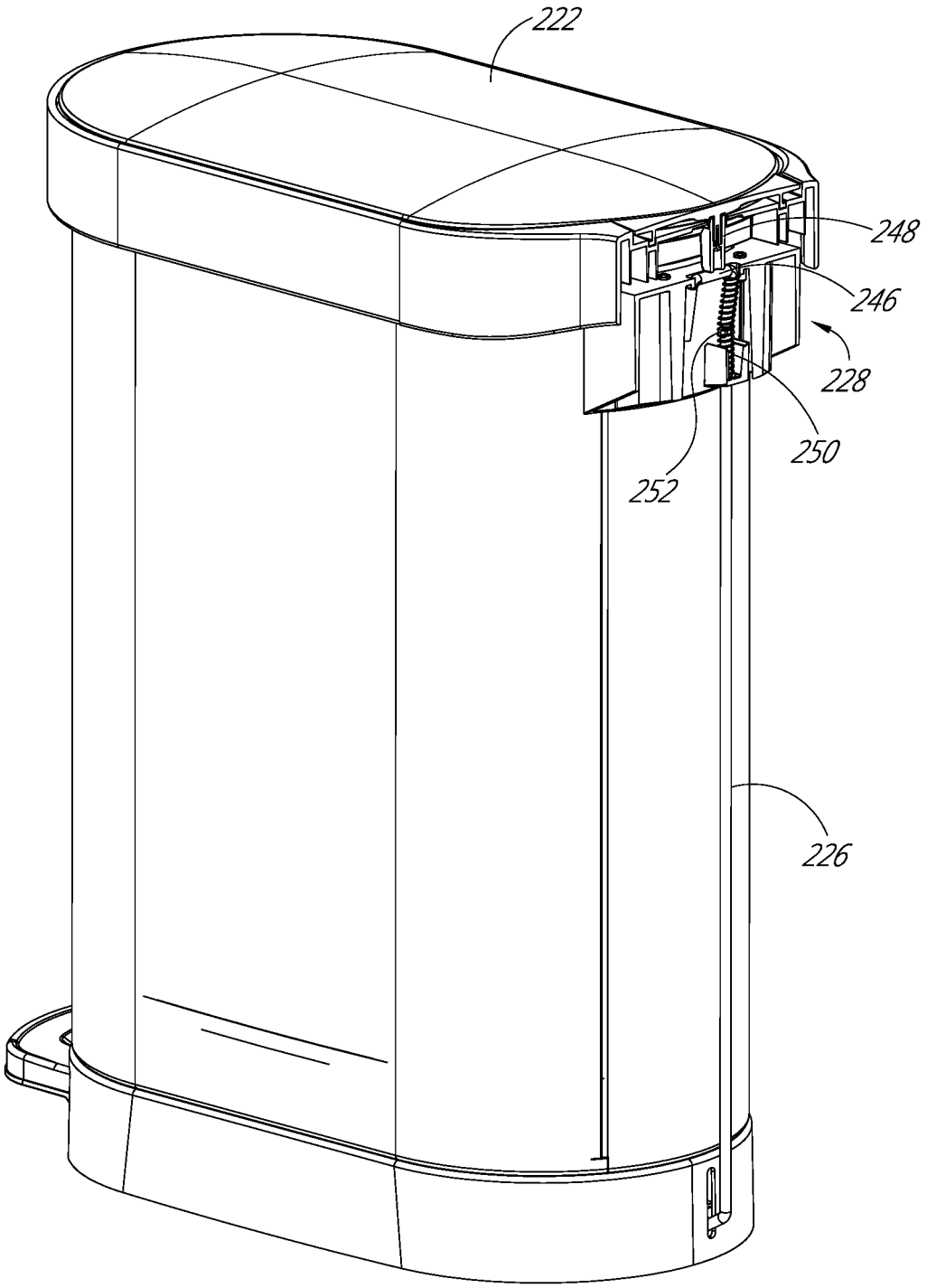
FIG. 15 illustrates a rear perspective cross-sectional view of the receptacle assembly of FIG. 13.

FIGS. 13-15 illustrate another embodiment of a receptacle assembly 210. Many of the features of the receptacle assembly 210 are the same as, or similar to, the features described above in connection with the receptacle assembly 10 and/or the receptacle assembly 110. The receptacle assembly 210 can include one, some, or all of the features of the receptacle assembly 10 and/or the receptacle assembly 110, including all combinations and sub-combinations.

As illustrated in FIG. 13, the receptacle assembly 210 can include a body unit 212, a lid unit 214, and a base unit 216. The lid unit 114 can include a lid 222 that is moveably coupled with the body unit 112, such as with a hinge. This can enable the lid 222 to move between open and closed positions. As shown, the lid 222 can be elongate in shape, such as being generally obround in shape. In some embodiments, the front-to-rear length of the lid 222 is greater than the lateral width of the lid 222. For example, the length of the lid 222 can be at least about twice the lateral width of the lid 222.

As shown in FIG. 14, the body unit 212 can include a chamber C for receiving articles, such as trash. The base unit 216 can include a foot pedal 218 and a damper 220. The motion damper 220 can be configured to dampen and/or regulate the movement of one or more of the components of the receptacle assembly 210. For example, the motion damper 220 can dampen (e.g., slow and/or control) movement of the lid 222 from the open position toward the closed position and/or from the closed position toward the open position. As shown, the motion damper 220 can extend above the foot pedal 218. The motion damper 220 can be positioned near the front of the body unit 212, similar to the motion damper 120 described above. In some embodiments, the motion damper 220 directly engages the foot pedal 218. For example, the motion damper 120 can directly dampen movement of the foot pedal 218, rather than dampening movement of a rod to indirectly dampen movement of the foot pedal 218.

As illustrated in FIG. 15, the foot pedal 218 can be operably connected with the lid unit 214 via a force-communicating linkage, such as a rod 226. In response to the front of the foot pedal 218 being depressed, the rod 226 is lifted, which causes an upper portion 246 of the rod 226 to press against an engagement portion 248 (e.g., a flange) of the lid 222, which in turn causes the lid 222 to rotate toward the open position. As shown, in some implementations, the upper portion 246 of the rod 226 is generally "U" shaped.

In some embodiments, the receptacle assembly 210 includes a secondary dampening feature, such as a secondary motion damper 250. As illustrated in FIG. 15, the secondary motion damper 250 can comprise a biasing member, such as a spring (e.g., a helical coil spring). The secondary motion damper 250 can be positioned in a rear housing 228 and/or outside the chamber C. As illustrated, in some embodiments, an upper portion and/or lower portion of the secondary motion damper 250 is engaged with (e.g., abut against) a portion of the rear housing 228. For example, the lower portion (e.g., the bottom) of the secondary motion damper 250 can be secured to a portion of the rear housing 228, such as with an adhesive, fastener, physical interference, or otherwise. In various embodiments, the secondary motion damper 250 is at or near the rear of the assembly 210.

As shown, the secondary motion damper 250 can be positioned over and/or receive a portion of the rod 226. For example, the secondary motion damper 250 can include a longitudinal interior passage that receives a portion of the rod 226. In some embodiments, the secondary motion damper 250 engages with an engagement feature of the rod 226. For example, the secondary motion damper 250 can abut against and/or physically interfere with a flange 252 of the rod 226. As shown, in some implementations, the engagement between the secondary motion damper 250 and the flange 252 occurs at a middle portion of the secondary motion damper 250. In some variants, the engagement between the secondary motion damper 250 and the flange 252 occurs at an end of the secondary motion damper 250.

In certain implementations, when the lid 222 is in the closed position, the secondary motion damper 250 is in an energized (e.g., compressed) state. For example, as shown in FIG. 15, the secondary motion damper 250 can be compressed between the rear housing 228 and a portion of the rod 224, such as a bend in the rod. In the energized state, the secondary motion damper 250 can store an amount of energy (e.g., potential energy).

In some embodiments, when the front of the foot pedal 218 is depressed, the rod 226 is lifted, which releases some of the energy stored in the secondary motion damper 250. For example, in the embodiment of FIG. 15, when the front of the foot pedal 218 is depressed, the rod 226 is lifted, the lid 222 opens, and the spring moves from a compressed state to an extended state. This applies a force to the lid 222 (e.g., via the rod 226), which can aid in driving the lid 222 toward the open position. Using the secondary motion damper 250 to apply force to the lid 222 can be particularly useful in helping to open certain types of lids 222, such as lids that are heavy and/or lids 222 that are elongate in shape (e.g., due to the moment caused by the length of the elongate lid 222 from the pivot axis of the lid 222). In various embodiments, the secondary motion damper 250 is configured to assist a user in opening the lid 222, such as by reducing the amount of force that the user needs to apply to the foot pedal 218.

In several embodiments, when the lid 222 is closing, the secondary motion damper 250 provides dampening, such as by slowing the rate that the lid 222 moves toward the closed position. In some implementations, when the front of the foot pedal 218 is released, the rod 226 moves downward, the lid 222 moves toward the closed position, and the helical coil spring is reenergized (e.g., returns to the compressed state), thereby dampening movement of the lid 222 as it closes.

In some embodiments, the motion damper 220 and the secondary motion damper 250 work together to dampen movement of the lid 222. For example, in certain variants, the motion damper 220 dampens movement of the lid 222 in a first phase of closing movement (e.g., from less than or equal to about 90° to greater than or equal to about 40°) and the secondary motion damper 250 dampens movement of the lid 222 in a second phase of closing movement (e.g., from less than or equal to about 40° to greater than or equal to about 0°). In various embodiments, the motion damper 220 and the secondary motion damper 250 are different types of dampers, such as one being a fluid damper and the other being a biasing member (e.g., a spring).

In some embodiments, when the front of the foot pedal 218 is depressed, the rod 226 is lifted, which acts against and/or energizes (e.g., extends or compresses) the secondary motion damper 250. For example, when the front of the foot pedal 218 is depressed, the rod 226 is lifted, the lid 222 opens, and the helical coil spring is extended. This can be, for example, because the lower portion of the helical coil spring is held fixed to the rear housing 228 and the upper portion of the helical coil spring is moved upward due to the engagement with the flange 252 of the rod 226.

In some variants, the assembly 210 is configured such that the secondary motion damper 250 is compressed when the rod 226 is lifted. For example, the secondary motion damper 250 can be compressed between the rear housing 228 and the upper portion 246 of the rod 226. In certain variants, when the front of the foot pedal 218 is released, the rod 226 moves downward, the lid 222 closes, and the helical coil spring extends.

As mentioned above, in various embodiments, the secondary motion damper 250 can dampen (e.g., act against) movement of the lid 222 and/or the rod 226. For example, the secondary motion damper 250 can provide dampening during at least some of the movement of the lid 222 between the open and closed positions, such as from the open to the closed position. This can, in some implementations, aid in providing a generally smooth movement of the lid 222 (e.g., a substantially consistent speed during at least part of the travel between the closed and open positions) and/or more controlled movement of the lid 222.

In certain embodiments, dampening of the lid 222 can be particularly beneficial. For example, in some embodiments with an elongate lid, when the lid 222 is moved from the open toward the closed position, the front of the lid 222 can appear to move with an overly rapid angular velocity (for example, due to the distance between the front of the lid and the pivot axis of the lid). Such overly rapid movement of the lid 22 can be undesirable, since it can be perceived as the lid 222 being uncontrolled, surprising, and/or indicative of a lesser quality product. In some embodiments, such overly rapid movement of the lid 222 can be reduced or avoided by the secondary motion damper 250. For example, as discussed above, the secondary motion damper 250 can dampen movement of the lid 222, which can reduce the angular velocity at which the front of the lid 222 travels.

6. Certain Methods

Figure 16:
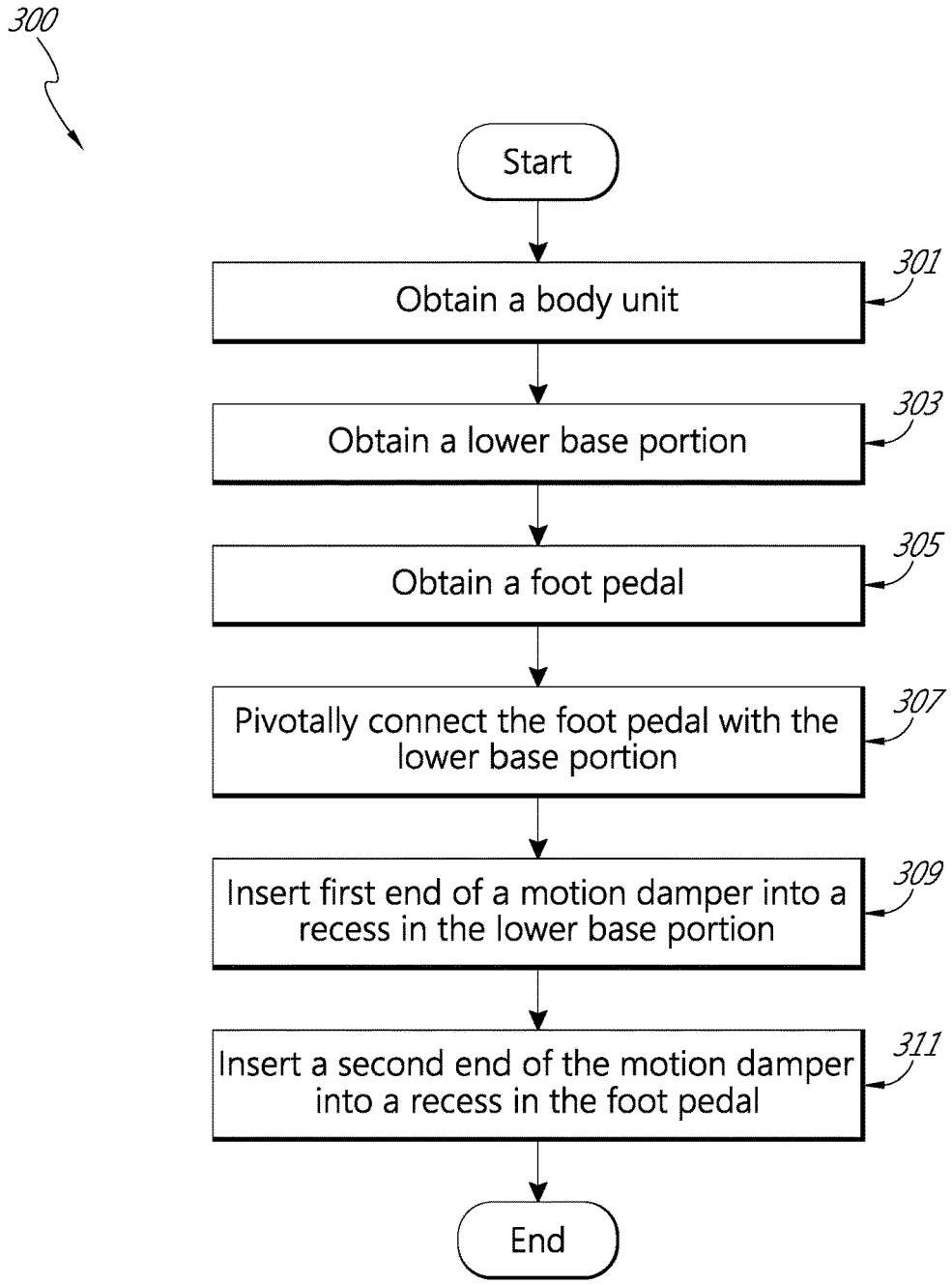
FIG. 16 schematically illustrates a method of manufacturing a receptacle assembly.

This disclosure includes methods related to receptacle assemblies, such as methods of making and/or using the receptacle assemblies described above. As shown in FIG. 16, a method of manufacturing a receptacle assembly 300 includes obtaining portions of the receptacle assembly. For example, the method 300 can include obtaining a body unit 301 and obtaining a lower base portion 303. In some embodiments, the method 300 includes connecting the body unit and the lower base portion. The method 300 can include obtaining a foot pedal 305. Some variants include pivotally connecting the foot pedal to the lower base portion 307.

In certain implementations, the method 300 includes obtaining a motion damper. As shown, the method 300 can include inserting a first end of the motion damper into a recess in the lower base portion 309, such as a recess in a front portion of the lower base portion. In some embodiments, inserting the first end into the recess in the lower base portion includes inserting the first end upwardly into the recess. The method 300 can include inserting a second end of the motion damper into a recess in the foot pedal 311, such as a recess in a front portion of the foot pedal. In some embodiments, inserting the second end into the recess in the foot pedal includes inserting the second end downwardly into the recess.

Various embodiments include positioning the damper near a front of the receptacle assembly. For example, some embodiments include inserting the motion damper near (e.g., adjacent) a front of the receptacle assembly, such as a front wall of the body unit. Some embodiments include securing the motion damper to the foot pedal and/or the lower base portion without the use of a fastener, such as a screw or rivet. For example, some embodiments include inserting the motion damper into the recess in the foot pedal and/or the lower base portion with an interference fit. Certain implementations do not include positioning and/or securing the motion damper to a rear portion of the receptacle assembly, such as to a rear wall of the body unit and/or to a rear portion of the lower base portion.

In some embodiments, the method includes connecting the lower base portion with an upper base portion to form a base unit. In some variants, the method includes receiving a part of the recess of the lower base portion in a compartment in the upper base portion. For example, the recess of the lower base portion can be included in an upward projection in the lower base portion, and the upward projection can be received in the compartment.

In some embodiments, the receptacle assembly that is the result of the method of manufacturing has a substantially continuous rear wall. For example, certain implementations do not include forming a damper-access hole in a rear wall of the body portion and/or covering the damper-access hole with a cover.

Some embodiments of the method include installing a secondary motion damper, such as a biasing member (e.g., a spring). For example, the secondary motion damper can be positioned in a rear housing of the receptacle assembly. Certain embodiments include inserting a linkage into the secondary motion damper. Some embodiments include positioning the biasing member around a portion of the linkage. Some variants include engaging a portion (e.g., a flange) of the linkage with the secondary motion damper. Certain embodiments of the method include configuring the receptacle assembly such that the secondary motion damper dampens movement of the linkage and/or the lid. For example, the secondary motion damper can be configured to be energized by and/or to act against movement of the lid, such as at least during a phase of movement of the lid from the open position toward the closed position. In some implementations, the phase comprises movement of the lid from about an angle of greater than or equal to about 0° through an angle of less than or equal to about 45°. In some implementations, the phase comprises movement of the lid from about an angle of less than or equal to about 90° through an angle of greater than or equal to about 40°.

7. Certain Terminology

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

8. Summary

Although the receptacle assemblies have been disclosed in the context of certain embodiments and examples, the receptacle assemblies extend beyond the specifically disclosed embodiments to other alternative embodiments and/or uses of the embodiments and certain modifications and equivalents thereof. For example, although certain embodiments with a foot pedal are described above, some embodiments include a handle, lever, button, or other actuator that is configured to be actuated by a user to open and close the lid. Any two or more of the components of the receptacle assembly can be made from a single monolithic piece or from separate pieces connected together. Various features and aspects of the disclosed embodiments can be combined with or substituted for one another in order to form varying modes of the invention. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of receptacle assemblies have been disclosed. Although the receptacle assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Thus, the scope of this disclosure should not be limited by the particular disclosed embodiments described above, but should be determined only by a fair reading of the claims that follow.

The following is claimed:

1. A trash can comprising:

a body unit comprising a front wall, a rear wall, a chamber, and a peripheral lip, the peripheral lip configured to mate with a trash bag such that the trash bag is received in the chamber;

a lid unit coupled to an upper end of the body unit, the lid unit comprising:

a lid configured to pivot between a closed position and an open position; and a trim ring configured to pivot between a lower position and an upper position, the trim ring being engaged around a portion of the peripheral lip of the body unit in the lower position, a front of the trim ring being pivoted upward from the peripheral lip in the upper position; and a base unit located on a lower portion of the body unit, the base unit comprising:

a base portion that bounds a bottom of the chamber that receives the trash bag, the base portion comprising a protrusion that extends into the chamber;

a foot pedal connected with the base portion and configured to move between a resting position and an actuated position, the foot pedal operably connected with the lid such that movement of the foot from the resting position to the actuated position moves the lid from the closed position to the open position; and a motion damper positioned near the front wall and between the base portion and the foot pedal, the motion damper configured to dampen movement of the foot pedal from the actuated position to the resting position, an end of the motion damper being positioned in the protrusion that extends into the chamber.

2. The trash can of claim 1, wherein the motion damper is positioned adjacent the front wall.

3. The trash can of claim 1, wherein the motion damper is positioned at about a lateral midpoint of the trash can.

4. The trash can of claim 1, wherein:

the foot pedal further comprises a lower recess; and an upper portion of the motion damper is received in the protrusion and a lower portion of the motion damper is received in the lower recess.

5. The trash can of claim 1, wherein the trash can is configured such that, when the foot pedal is moved from the resting state to the actuated state, a portion of the motion damper slides along the foot pedal.

6. The trash can of claim 1, wherein the trash can is configured such that, when the foot pedal is in the resting state, the motion damper is encapsulated by the foot pedal and the base portion.

7. The trash can of claim 1, wherein, from a top plan view and a rear elevation view, the motion damper is hidden from view when the lid is in the open position and when the lid is in the closed position.

8. The trash can of claim 1, wherein the motion damper is positioned in the front quarter of the front-to-rear width of the body unit.

9. The trash can of claim 1, wherein the motion damper is not connected with the rear wall and not positioned on an exterior surface of the trash can.

10. The trash can of claim 1, further comprising a secondary motion damper that is configured to dampen movement of the lid during movement of the lid from the open position toward the closed position.

11. The trash can of claim 10, wherein the secondary motion damper comprises a spring.

12. A receptacle assembly comprising:

a body unit comprising a front wall, a rear wall, and a chamber;

a lid unit comprising a lid configured to pivot between a closed position and an open position;

a base unit comprising:

a protrusion that extends into the chamber;

a foot pedal operably connected with the lid such that, in response to a user depressing a front of the foot pedal, the lid moves from the closed position to the open position, the foot pedal comprising a motion damper engaging region; and a motion damper positioned near the front wall, the motion damper comprising a first end that is engaged with the motion damper engaging region and a second end that is received in the protrusion, the motion damper being configured to dampen movement of the foot pedal and the lid.

13. The receptacle assembly of claim 12, wherein the base unit further comprises a lower base portion, the motion damper being positioned vertically between the foot pedal and the lower base portion.

14. The receptacle assembly of claim 12, wherein the motion damper engaging region comprises a recess.

15. The receptacle assembly of claim 12, wherein the receptacle assembly is configured such that, when the foot pedal is depressed, the motion damper is encapsulated by the foot pedal and the base portion.

16. The receptacle assembly of claim 12, wherein the receptacle assembly is configured such that, when the foot pedal is depressed, a portion of the motion damper slides along the foot pedal.

17. The receptacle assembly of claim 12, wherein the receptacle assembly comprises a trash can.

18. The receptacle assembly of claim 12, further comprising a secondary motion damper that is configured to dampen movement of the lid during movement of the lid from the open position toward the closed position.

19. The receptacle assembly of claim 18, wherein the secondary motion damper comprises a spring.

20. A method of manufacturing a receptacle assembly, the method comprising:

obtaining a body, with a lid unit, and a base portion;

pivotally connecting a foot pedal with the base portion, the base portion comprising a protrusion that extends into a chamber bounded by at least the body unit and the base portion;

operably connecting a linkage with the foot pedal such that, when the lid unit is assembled with the body unit, the lid is configured to move in response to movement of the foot pedal;

positioning a first end of the motion damper between the foot pedal and the base portion;

positioning a second end of the motion damper in the protrusion; and vertically compressing the motion damper between the foot pedal and the base portion.

21. The method of claim 20, further comprising positioning the motion damper near a front wall of the body unit.

22. The method of claim 21, further comprising positioning the motion damper near a lateral midpoint of the body unit.

23. The method of claim 20, further comprising receiving the first end of the motion damper in a recess in the foot pedal.

24. The method of claim 20, wherein:

the base portion comprises an upper base portion and a lower base portion, the upper base portion comprising a bottom boundary of the chamber, the receptacle assembly configured to rest on the lower base portion; and the method further comprises:

attaching the upper base portion and the lower base portion; and forming the protrusion, wherein forming the protrusion comprises receiving a bulge of the lower base portion in a compartment of the upper base portion.

25. The method of claim 20, further comprising positioning a biasing member around a portion of the linkage.

26. The method of claim 20, further comprising compressing a secondary motion damper between a rear portion of the lid and a portion of the linkage.

27. The trash can of claim 1, wherein the end of the motion damper is positioned at an elevation that is higher than a bottom-most surface of the chamber.

28. The trash can of claim 1, wherein the protrusion extends vertically upward into the chamber.

29. The trash can of claim 1, wherein the protrusion is cylindrical.

30. The trash can of claim 1, wherein the protrusion separates a trash bag in the chamber from the motion damper.

31. The trash can of claim 1, wherein the second end of the motion damper is positioned at an elevation that is higher than a bottom-most surface of the chamber.

32. The trash can of claim 1, wherein the base portion comprises an upper base portion coupled to a lower base portion.

33. The receptacle assembly of claim 12, wherein the protrusion extends vertically upward into the chamber.

34. The receptacle assembly of claim 12, wherein the protrusion is cylindrical.

35. The receptacle assembly of claim 12, wherein the protrusion separates a trash bag in the chamber from the motion damper.

* * * * *